US007878133B2

(12) United States Patent
Tokura et al.

(10) Patent No.: US 7,878,133 B2
(45) Date of Patent: Feb. 1, 2011

(54) SEWING MACHINE AND COMPUTER-READABLE RECORDING MEDIUM STORING SEWING MACHINE OPERATION PROGRAM

(75) Inventors: Masashi Tokura, Nagoya (JP); Masahiko Nagai, Nagoya (JP); Motoshi Kishi, Nagoya (JP); Tomohiko Mori, Inazawa (JP); Takafumi Naka, Ama-gun (JP); Tsuneo Okuyama, Inabe-gun (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 364 days.

(21) Appl. No.: 12/071,782

(22) Filed: Feb. 26, 2008

(65) Prior Publication Data

US 2008/0216725 A1 Sep. 11, 2008

(30) Foreign Application Priority Data

Mar. 6, 2007 (JP) ..... 2007-056070

(51) Int. Cl.
*D05B 19/16* (2006.01)
*D05C 5/02* (2006.01)

(52) U.S. Cl. ..... 112/470.04; 700/138

(58) Field of Classification Search ..... 112/102, 112/102.5, 117, 118, 470.01–470.18, 220, 112/221; 700/130–138
See application file for complete search history.

(56) References Cited

U.S. PATENT DOCUMENTS 4,388,883 A 6/1983 Hirota et al.
4,403,559 A 9/1983 Hirose
4,936,233 A 6/1990 Tajima et al.
4,976,552 A 12/1990 Ishikawa et al.
5,218,916 A * 6/1993 Kurono et al. ..... 112/102.5
5,826,526 A 10/1998 Tomita
5,836,260 A * 11/1998 Kawaguchi et al. ..... 112/277
5,957,070 A * 9/1999 Yoshida et al. ..... 112/470.04

(Continued)

FOREIGN PATENT DOCUMENTS

JP A-56-130181 10/1981

(Continued)

OTHER PUBLICATIONS

Jun. 30, 2010 Office Action for U.S. Appl. No. 12/071,784.

(Continued)

*Primary Examiner*—Ismael Izaguirre
(74) *Attorney, Agent, or Firm*—Oliff & Berridge, PLC

(57) ABSTRACT

A sewing machine includes a needle bar, a needle bar up-and-down movement mechanism that raises and lowers the needle bar, a needle bar up-and-down movement mechanism that raises and lowers the needle bar and a sewing machine motor for driving the needle bar up-and-down mechanism. The sewing machine further includes an operation device that is provided separately from a body of the sewing machine including at least one operation member to be operated by a user that outputs an output signal corresponding to an operation state of the operation member. The sewing machine also includes a command determination device that determines a command that corresponds to the output signal output by the operation device as a determined command and a drive control device that controls a predetermined operation of the sewing machine in accordance with the determined command.

12 Claims, 27 Drawing Sheets

U.S. PATENT DOCUMENTS

| | | | | |
|---|---|---|---|---|
| 6,161,491 | A | 12/2000 | Takenoya et al. | |
| 6,352,043 | B1 * | 3/2002 | Tajima et al. | 112/102.5 |
| 6,932,005 | B2 | 8/2005 | Tajima | |
| 7,069,870 | B2 | 7/2006 | Orii et al. | |
| 7,079,917 | B2 * | 7/2006 | Taguchi et al. | 700/138 |
| 7,239,935 | B2 | 7/2007 | Katagiri | |
| 7,460,925 | B2 * | 12/2008 | Noguchi | 700/138 |
| 7,715,940 | B2 * | 5/2010 | Muto et al. | 700/138 |
| 2003/0056702 | A1 * | 3/2003 | Tamai | 112/470.01 |
| 2006/0137582 | A1 | 6/2006 | Kawabe et al. | |
| 2008/0216721 | A1 | 9/2008 | Nagai et al. | |
| 2008/0257240 | A1 | 10/2008 | Grufman et al. | |

FOREIGN PATENT DOCUMENTS

| | | |
|---|---|---|
| JP | A-56-166887 | 12/1981 |
| JP | A-01-099594 | 4/1989 |
| JP | A-03-143473 | 6/1991 |
| JP | A-05-245277 | 9/1993 |
| JP | A-06-240557 | 8/1994 |
| JP | A-09-010455 | 1/1997 |
| JP | B2-2733769 | 1/1998 |
| JP | A-10-146481 | 6/1998 |
| JP | B2-2904822 | 3/1999 |
| JP | B2-2953018 | 7/1999 |
| JP | A-2001-321587 | 11/2001 |
| JP | A-2005-193027 | 7/2005 |
| JP | A-2006-020664 | 1/2006 |
| JP | A-2006-026147 | 2/2006 |
| JP | A-2006-026148 | 2/2006 |
| JP | A-2006-026149 | 2/2006 |
| JP | A-2006-271799 | 10/2006 |
| JP | A-2008-246186 | 10/2008 |

OTHER PUBLICATIONS

Noriharu Tashiro et al., U.S. Appl. No. 12/900,142, filed Oct. 7, 2010.
Tsuneo Okuyama et al., U.S. Appl. No. 12/900,090, filed Oct. 7, 2010.

* cited by examiner

FIG. 19

700

701 702 703

| COMMAND EXECUTION FREQUENCY | COMMAND | ILLUSTRATION |
|---|---|---|
| 40% | ROTATION | |
| 30% | SIZE | |
| 15% | CHARACTER SPACING | A B C |
| ⋮ | ⋮ | ⋮ |
| 5% | THREAD DENSITY | |

FIG. 26

800

801 802 803

| ID | REGISTERED GESTURE PATTERN | COMMAND |
|---|---|---|
| 1 | | PROCESSING A |
| 2 | | PROCESSING B |
| 3 | | PROCESSING C |

SEWING MACHINE AND COMPUTER-READABLE RECORDING MEDIUM STORING SEWING MACHINE OPERATION PROGRAM

CROSS-REFERENCE TO RELATED APPLICATION

This Application claims priority from JP 2007-56070, filed Mar. 6, 2007, the content of which is hereby incorporated by reference in its entirety.

BACKGROUND

The present disclosure generally relates to technical fields including a sewing machine and a sewing machine operation program recorded on a computer-readable recording medium. More specifically, it relates to a sewing machine that may include an operation device that is provided separately from a body of the sewing machine. The operation device may be equipped with at least one operation member which is operated by a user, that provides an output signal in accordance with the operation state of the operation member. The present disclosure also relates to a sewing machine operation program, recorded on a computer-readable recording medium, that may be used to operate the sewing machine.

Conventionally, a sewing machine is equipped with a treadle apparatus connected to a body of the sewing machine with a signal line cord, or buttons mounted on the body for controlling the driving of the sewing machine. Various operation instructions are assigned to the buttons. For example, a sewing machine is proposed on which buttons are disposed on a front surface of the body of the sewing machine (Japanese Patent Application Laid Open Publication No. 2006-271799). The buttons permit a presser foot to be moved among a lowered position, a raised position and a predetermined position between the lowered position and the raised position.

However, with the diversification of functions of a sewing machine, instructions used to drive the sewing machine have been diversified, thereby resulting in less space for the buttons to be mounted on the body of the sewing machine. Further, if a plurality of switches are disposed densely on the body of a sewing machine in order to accommodate the diversification of the instructions used to drive the sewing machine, it could be troublesome to distinguish among the switches when operating the sewing machine.

SUMMARY

Various exemplary embodiments of the broad principles herein provide a sewing machine with an improved operability at the time of inputting an instruction used to control predetermined operations of the sewing machine and a sewing machine operation program recorded on a computer-readable recording medium that operates the sewing machine.

Exemplary embodiments provide a sewing machine that includes a needle bar, a sewing needle mounted to the needle bar, a needle bar up-and-down movement mechanism that raises and lowers the needle bar, a sewing machine motor that drives the needle bar up-and-down movement mechanism, an operation device that is provided separately from a body of the sewing machine, and that includes at least one operation member to be operated by a user, the operation device outputting an output signal which corresponds to an operation state of the operation member, a command determination device that determines a command which corresponds to the output signal outputted by the operation device as a determined command and a drive control device that controls a predetermined operation of the sewing machine in accordance with the determined command determined by the command determination device.

Exemplary embodiments also provide a computer-readable recording medium that stores a sewing machine operation program for operating a sewing machine, the sewing machine including an operation device that includes at least one operation member to be operated by a user, and that outputs an output signal which corresponds to an operation state of the operation member, the program comprising instructions for acquiring an output signal that corresponds to an operation state of an operation member, instructions for determining a command that corresponds to the acquired output signal as a determined command and instructions for controlling a predetermined operation of the sewing machine in accordance with the determined command.

BRIEF DESCRIPTION OF THE DRAWINGS

Exemplary embodiments of the invention will be described below in detail with reference to the accompanying drawings in which:

FIG. 19 is an explanatory diagram of a table in which commands that may be assigned to a wheel are registered.

FIG. 26 is an explanatory diagram of a table in which registered gesture patterns to be referenced in the mouse entry processing are stored.

DETAILED DESCRIPTION OF EMBODIMENTS

Hereinafter, a sewing machine 1 according to exemplary embodiments will be described with reference to the drawings. The first through third embodiments are one example of applying the present disclosure to a sewing machine that may form a stitch on a work cloth while moving the work cloth with respect to a sewing needle moving up and down. First, the physical configuration and the electrical configuration of a sewing machine 1 that are common to the first through third embodiments will be described below.

First, the physical configuration of the sewing machine 1 will be described with reference to FIGS. 1 and 2. It is to be noted that in FIG. 1, the side of the paper toward the user is referred to as a "front side", the side thereof away from the user is referred to as a "rear side", and the right and left direction of the paper is referred to as "right and left direction".

Figure 1:
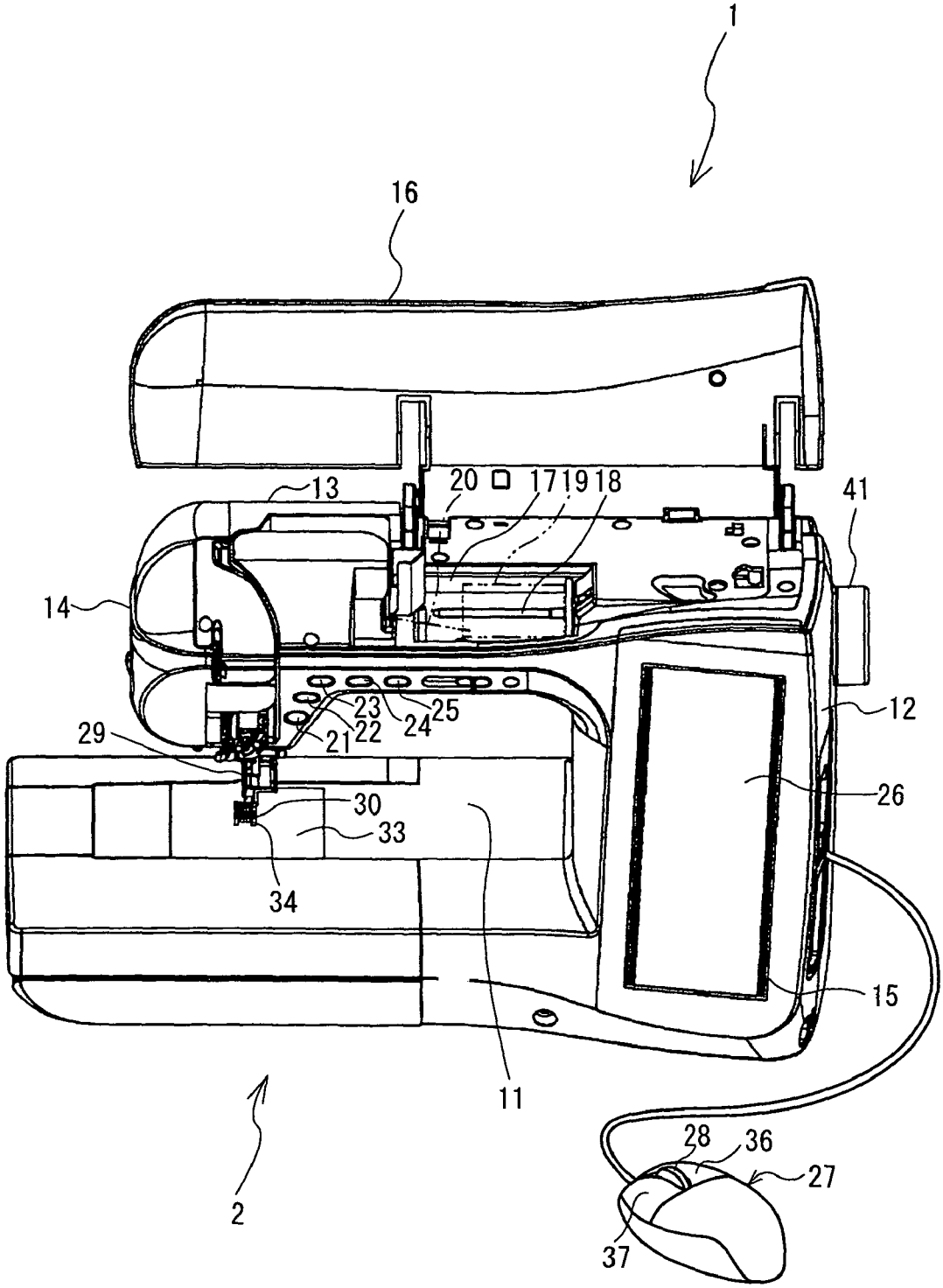
FIG. 1 is a perspective view of a sewing machine in a condition where a cover is opened.

As shown in FIG. 1, the sewing machine 1 may have a sewing machine bed 11, which may be long in the right and left directions, a pillar 12 which may be erected upward at the right end part of the sewing machine bed 11, and an arm portion 13 which, may extend leftwards in FIG. 1 at the upper end of the pillar 12. The left end part of the arm portion 13 is referred to as a head portion 14. The sewing machine bed 11 may be mounted with a needle plate 33, a feed dog 34, a cloth feed mechanism (not shown), a feed adjustment pulse motor 78 (see FIG. 3), and a shuttle mechanism (not shown). The needle plate 33 may be disposed on the top surface of the sewing machine bed 11. The feed dog 34 may be mounted under the needle plate 33, to feed a work cloth (not shown) for sewing by a predetermined feed distance. The cloth feed mechanism may be used to drive the feed dog 34. The feed adjustment pulse motor 78 may be used to adjust a feed distance by which the work cloth may be fed by the feed dog 34.

On the front surface of the pillar 12, a liquid crystal display (LCD) 15 having a vertically long rectangular shape may be mounted. The LCD 15 may display command names and illustrations to execute various commands used to set and edit a variety of patterns and control sewing. The LCD 15 may further display a variety of set values and various messages related to sewing.

On the front surface of the LCD 15, a touch panel 26 may be mounted to correspond to the display positions of the pattern names of a plurality of patterns and function names to perform various functions, numeric settings on a variety of setting screens, etc. The numeric settings on the various setting screens may include a feed distance for a work cloth by the feed adjustment pulse motor 78 and a needle bar swing distance by a needle bar swinging pulse motor 80. By pressing, with a finger or a dedicated touch pen, portions on the touch panel 26 that correspond to a pattern display portion and a setting portion on a screen displayed on the LCD 15, it is possible to select a pattern to be sewed, instruct a desired function, and set a numeral (which operation is hereinafter referred to as a "panel operation").

Further, on the right side surface of the pillar 12 in FIG. 1, a mouse 27 may be connected which is provided separately from a sewing machine body 2. The mouse 27 may be a rotary input device equipped with a wheel 28, which may be a plate-shaped rotation body. Besides the wheel 28, the mouse 27 may be equipped with a left button 37, a right button 36, and a movement detection section 35 (see FIG. 3) as operation members. In normal processing, like the touch panel 26, the mouse 27 may be used to enter various instructions to select and set various items displayed on the LCD 15. That is, during the normal processing, a cursor or a pointer (hereinafter simply referred to as "cursor") displayed on the LCD 15 may be moved in accordance with an output signal from the movement detection section 35 or an instruction may be inputted to select an item which is black-and-white reverse displayed by using the cursor. On the other hand, in later-described mouse entry processing, the mouse 27 may output signals in accordance with the operation states of the operating members and the user may input various commands to control the operations of the sewing machine 1.

It is to be noted that, hereinafter, the operation of the user pressing the left button 37 or the right button 36 of the mouse 27 once is referred to as "single click", the operation pressing it twice in a row is referred to as "double click", and the operation of continuous pressing of it is referred to as "continuous pressing". Further, the operation of the user moving the mouse 27 with the left button 37 held down is referred to as "dragging". Each operation of single clicking, double clicking, continuous pressing, and dragging of the left button 37 is referred to as a "left button operation", while each operation of single click, double click, continuous pressing, and dragging of the right button 36 is referred to as a "right button operation". The wheel may be rolled backward (towards the user) or forward (away from the user). Each operation of rolling the wheel 28 backward and forward is referred to as a "wheel operation". Each operation of left button operations, the right button operations, the wheel operations, and the operation of moving the mouse 27 is referred to as a "mouse operation".

Next, the configuration of the arm portion 13 will be described below. The arm portion 13 may be mounted with a cover 16 to open and close its upper part. The cover 16 may be provided in the longer direction of the arm portion 13 and may be axially supported in the right and left direction at the upper rear end part of the arm portion 13 to open and close it. In the vicinity of the middle of the upper part of the arm portion 13 in an opened-state of the cover 16, a thread housing portion 17 may be provided, which may be a concave portion containing a thread spool 19 which may supply a thread to the sewing machine 1. From an internal wall surface of the thread housing portion 17 on the side of the pillar 12, a thread spool pin 18 may be disposed which protrudes towards the head portion 14, to attach the thread spool 19. The thread spool 19 may be attached by inserting the thread spool pin 18 through an insertion hole of the thread spool 19. A needle thread 20 extending from the thread spool 19 may be supplied via a thread hooking section (not shown) to a sewing needle 29 attached to a needle bar 40 (see FIGS. 2 and 3). The thread hooking section may include a tensioner and a thread take-up spring (not shown), which may adjust the tension of a thread, which may be provided in the head portion 14. The thread hooking section may further include a thread take-up lever, which may reciprocate vertically to pull up the needle thread 20.

The lower part on the front surface of the arm portion 13 may be provided with a sewing start/stop switch 21, a reverse stitch switch 22, a needle up/down switch 23, a presser foot up/down switch 24, an automatic threading switch 25, etc. The sewing start/stop switch 21 may be used to start and stop the running of the sewing machine 1, that is, to instruct sewing to be started and stopped. The reverse stitch switch 22 may be used to feed a work cloth from the rear side to the front, which may be opposite to the normal direction. The needle up/down switch 23 may be used to switch the stop position of the needle bar 40 (see FIGS. 2 and 3) between an upper position and a lower position. The presser foot up/down switch 24 may be used to instruct the presser foot 30 to be raised and lowered. The automatic threading switch 25 may be used to instruct the start of automatic threading for leading needle thread through the thread take-up lever, the tensioner, the thread take-up spring and for threading the sewing needle 29.

Figure 2:
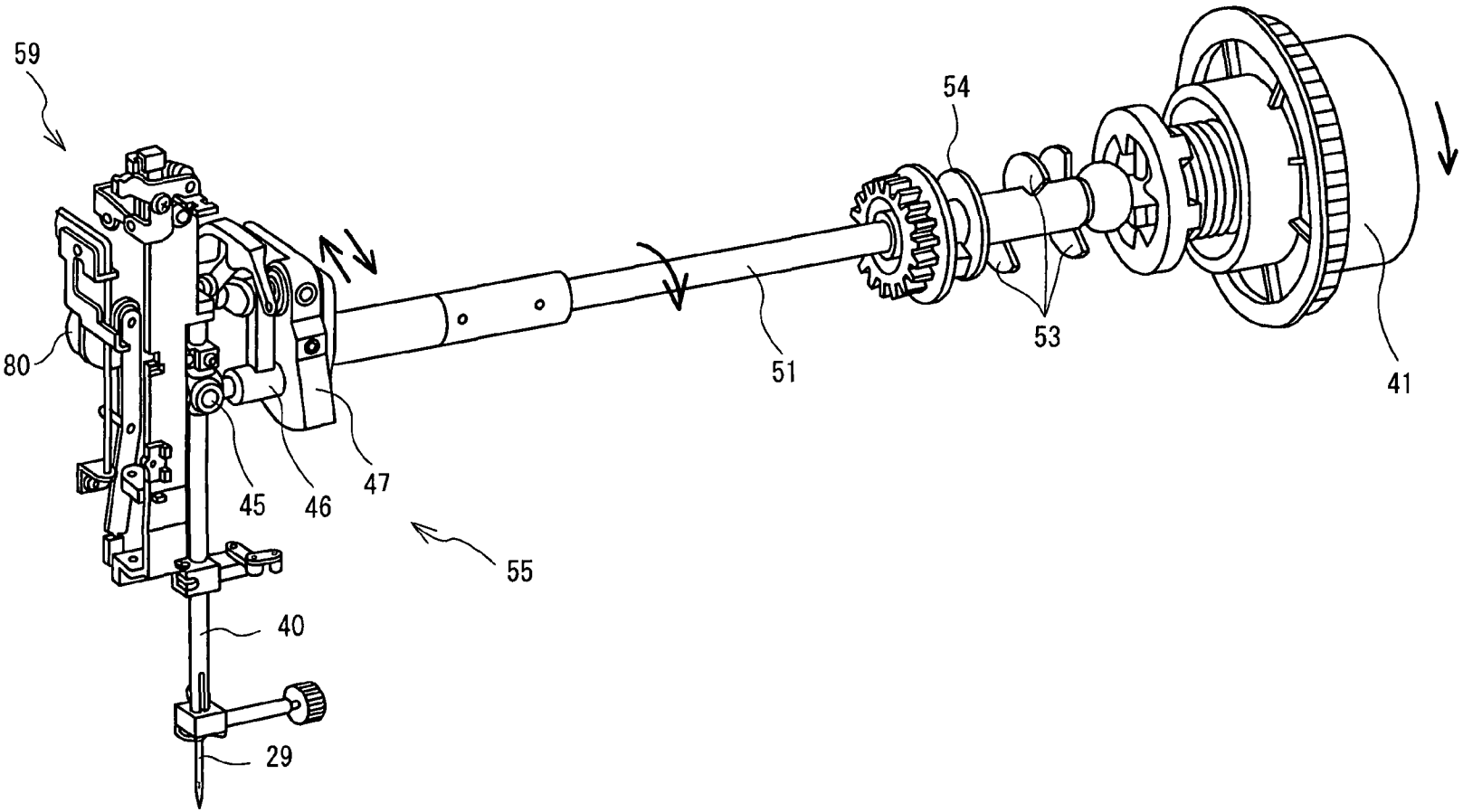
FIG. 2 is a perspective view of a needle bar and a needle bar up-and-down movement mechanism of the sewing machine.

Further, as shown in FIG. 2, the arm portion 13 may also be mounted with a drive shaft 51, which may be rotated by a sewing machine motor 79 and which may extend in the longer direction of the arm portion 13. At the right end of the drive shaft 51, a pulley 41 may be fixed to manually rotate the drive shaft 51. At the head portion 14, which may be the left end part of the arm portion 13, as shown in FIGS. 1 and 2, a needle bar up-and-down movement mechanism 55, a needle bar swinging mechanism 59, and a thread take-up mechanism (not shown) may be provided. The needle bar up-and-down movement mechanism 55 may be used to drive up and down the needle bar 40 to which the sewing needle 29 may be attached. The needle bar swinging mechanism 59 may be used to swing the needle bar 40 in the right and left direction by using the needle bar swinging pulse motor 80 as a source of power. Further, behind the needle bar 40, a presser bar (not shown) may be disposed. At the lower end part of the presser bar, a presser foot 30 (see FIG. 1) may be attached to press a work cloth.

Figure 3:
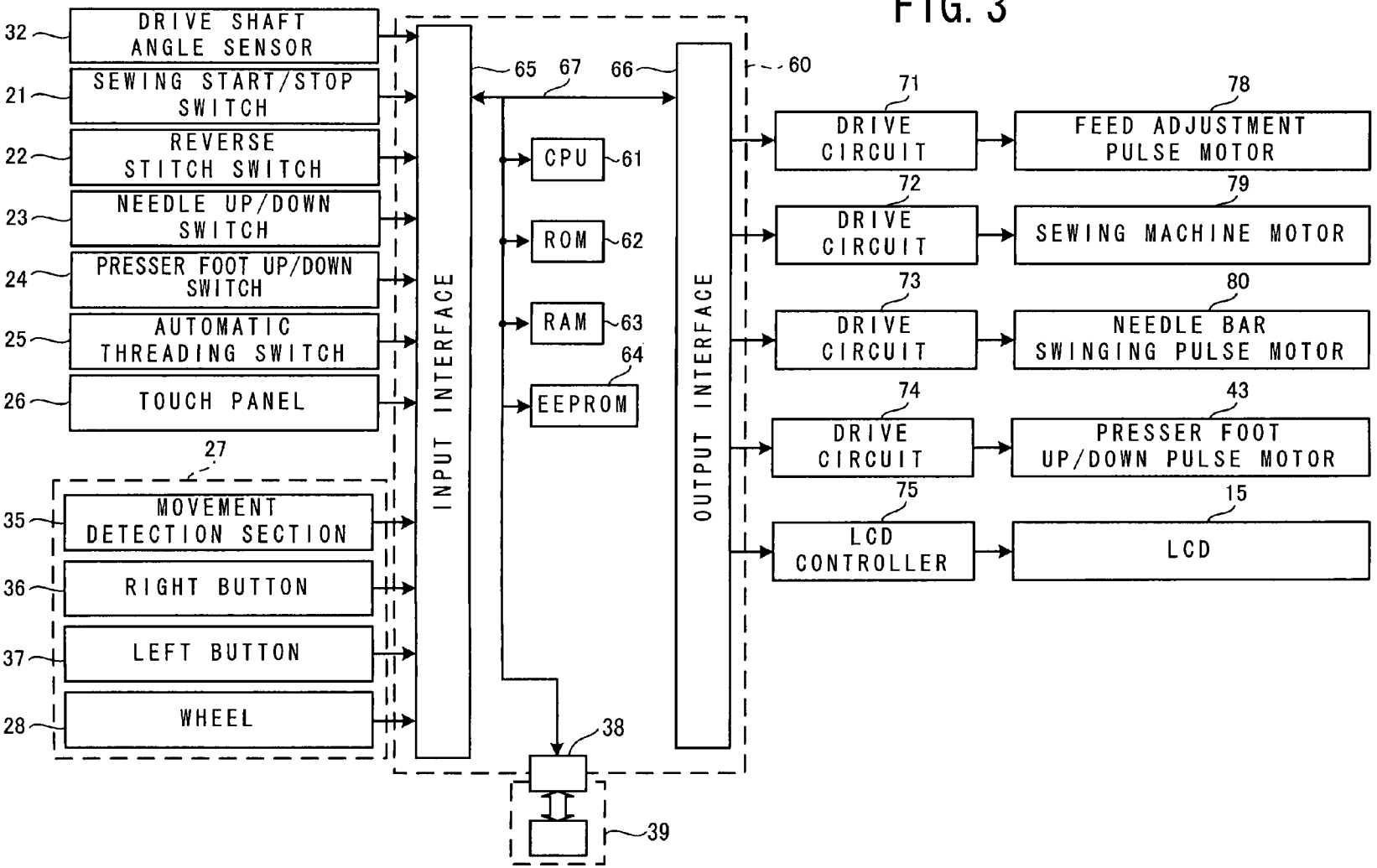
FIG. 3 is a block diagram of the electrical configuration of a sewing machine.

As shown in FIG. 2, the needle bar up-and-down movement mechanism 55 may include the drive shaft 51, a thread take-up lever crank 47, a needle bar crank rod 46, and a needle bar guide bracket 45. The drive shaft 51 may be bar-shaped and may extend in the right and left direction. A left end part of the drive shaft 51 may be fixed to the right side surface of the thread take-up lever crank 47, while the upper end part of the needle bar crank rod 46 may be coupled to the left side surface of the thread take-up lever crank 47 in such a manner that the needle bar crank rod 46 may be rotationally movable. To the lower end of the needle bar crank rod 46, the needle bar guide bracket 45, which supports the needle bar 40, may be coupled. The needle bar 40 may be moved up and down by the needle bar up-and-down movement mechanism 55 using the sewing machine motor 79, as shown in FIG. 3, as a source of power. When the drive shaft 51 rotates as it is driven by the sewing machine motor 79, the rotary movement of the drive shaft 51 may be transmitted to the needle bar guide bracket 45 as an up-and-down movement via the thread take-up lever crank 47 and the needle bar crank rod 46. Simultaneously, together with the needle bar guide bracket 45, the needle bar 40 may also move up and down. Further, the drive shaft 51 may be mounted with a rotary shutter 53, which may be constituted of a plurality of fan-shaped shield plates and an encoder disk 54 in which a plurality of minute slits may be formed. A drive shaft angle sensor 32 (see FIG. 3) which may optically detect the rotation of the rotary shutter 53 and the encoder disk 54 may be mounted to a sewing machine frame (not shown). A rotation angle of the drive shaft 51, which may be detected by the drive shaft angle sensor 32, may be used to determine the vertical position of the needle bar 40. The needle bar swinging mechanism 59 shown in FIG. 2, which may be used to move the needle bar 40 in the right and left direction, may swing the needle bar 40 in the right and left direction by driving a decentralized cam (not shown), which may be rotated by using the needle bar swinging pulse motor 80 as a source of power.

Figure 4:
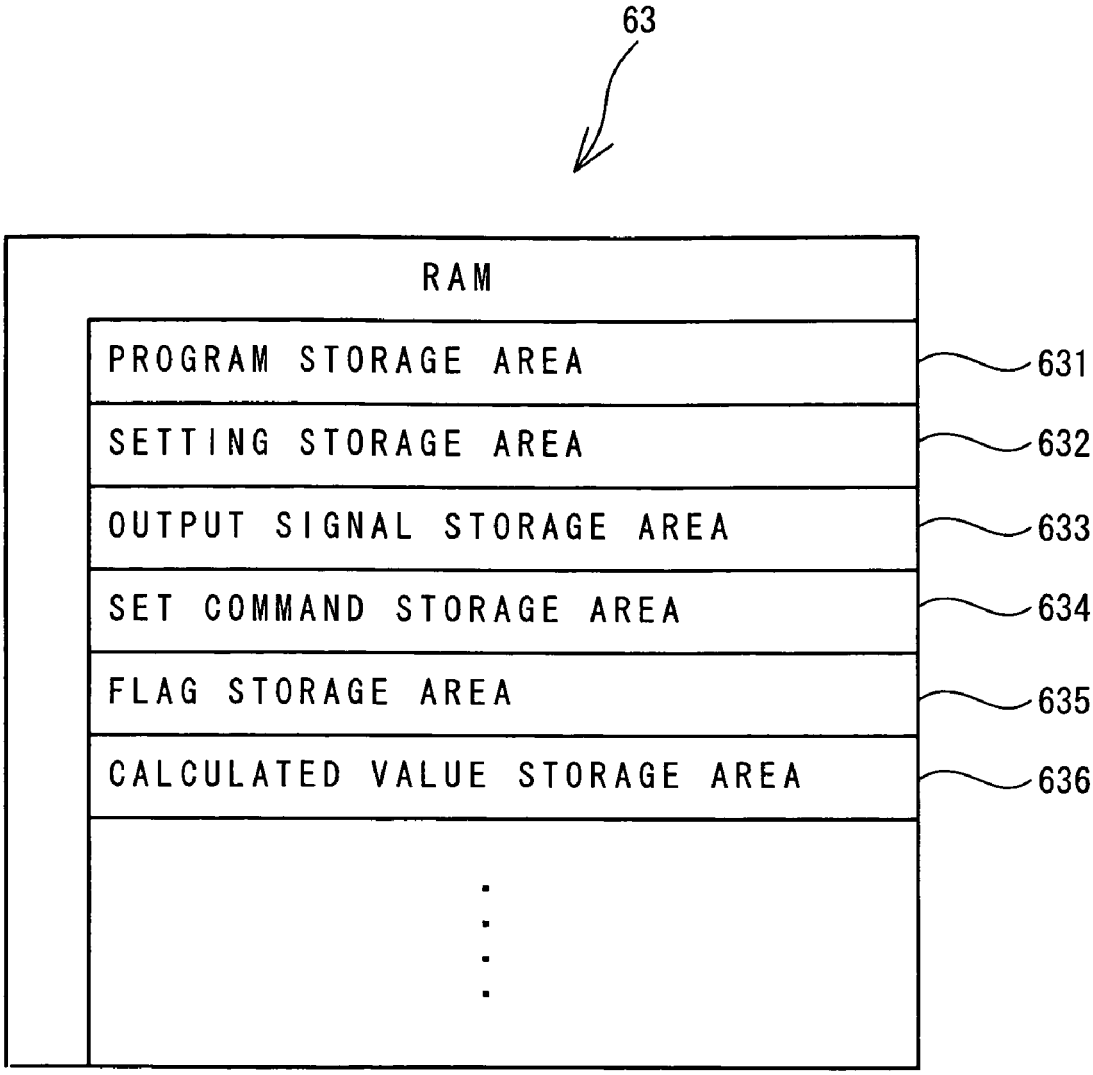
FIG. 4 is an explanatory conceptual diagram of the storage areas of a RAM.

Next, the electrical configuration of the sewing machine 1 will be described below with reference to FIGS. 3 and 4. As shown in FIG. 3, a control section 60 of the sewing machine 1 may include a CPU 61, a ROM 62, a RAM 63, an EEPROM 64, an input interface 65, an output interface 66, and a connector 38, which may be connected to each other via a bus 67. To the input interface 65, the drive shaft angle sensor 32, the sewing start/stop switch 21, the reverse stitch switch 22, the needle up/down switch 23, the presser foot up/down switch 24, the automatic threading switch 25, the touch panel 26, and the mouse 27, etc., may be connected. The mouse 27 may provide an output signal based on the operations of the operation members, for example, the right button 36, the left button 37, and the wheel 28, and an output signal based on a movement direction and a movement distance of the mouse 27 detected by the movement detection section 35. To the output interface 66, the feed adjustment pulse motor 78, the sewing machine motor 79, the needle bar swinging pulse motor 80, a presser foot UP/DOWN pulse motor 43, and the LCD 15 may be electrically connected via drive circuits 71-74 and an LCD controller 75, respectively. The sewing machine motor 79 may be used to rotate the drive shaft 51 (see FIG. 2). The needle bar swinging pulse motor 80 may be used to drive the needle bar 40 (see FIG. 2) in a swinging manner. Further, the connector 38 may be configured so that it may be connected with an external storage device 39. The following will describe in detail the CPU 61, the ROM 62, and the RAM 63, which may configure the control section 60 of the sewing machine 1.

The CPU 61 may be responsible for the main control of the sewing machine 1, and may perform various operations and processing for the purpose of sewing, in accordance with a sewing control program stored in the ROM 62. Further, the CPU 61 may perform various operations and processing in accordance with a sewing machine operation program stored in the ROM 62. It is to be noted that the sewing machine operation program may be stored in the external storage device such as a memory card, in which case the CPU 61 may read the sewing machine operation program into the RAM 63 and execute the program.

The ROM 62 may have a plurality of storage areas, for example, a sewing control program storage area, a sewing machine operation program storage area, and a setting storage area. In the sewing control program storage area, the sewing control program that may conduct various kinds of control including drive control over the various drive mechanisms, pattern selection control to select a variety of patterns, and various display control, may be stored. In the sewing machine operation program storage area, the sewing machine operation program that controls a predetermined operation of the sewing machine 1 in accordance with an output signal provided from the mouse 27, may be stored. In the setting storage area, a variety of settings, which may be referenced during the execution of the sewing machine operation program, may be stored. It is to be noted that some or all of these various programs and settings may be stored in the EEPROM 64 or the data stored in the external storage device may be read into the sewing machine 1.

The RAM 63 is a storage device that may be randomly readable and writable. In the RAM 63, a variety of storage areas may be provided as necessary and that may store various programs read from the ROM 62, various settings read from the EEPROM 64 and the result of computations performed by the CPU 61. The storage areas of the RAM 63 will be described in detail below with reference to FIG. 4. As shown in FIG. 4, the RAM 63 may have a program storage area 631, a setting storage area 632, an output signal storage area 633, a set command storage area 634, a flag storage area 635, a calculated value storage area 636, etc. The program storage area 631 may store the various programs read from the ROM 62. The setting storage area 632 may store various settings including a setting value and a table which may be referenced during the execution of the programs read from the ROM 62. The output signal storage area 633 may store the output signal, which may be output from the mouse 27 and may correspond to the operation state of an operation member of the mouse 27. The set command storage area 634 may store commands, which may be assigned to the output signals provided from the mouse 27. The flag storage area 635 may store various flags, which may be used during the execution of the programs. The calculated value storage area 636 may store various values, which may be calculated during the execution of the programs read from the ROM 62.

Next, a processing procedure of the first embodiment of the above-described sewing machine 1 that controls predetermined operations of the sewing machine 1 by using the mouse 27 will be described below with reference to FIGS. 5-13. As Example 1, a case will be described below where output signals that correspond to the operation states of the left button 37, the right button 36, and the wheel 28, which configure the mouse 27, may be assigned commands related to sewing by the sewing machine 1. It is to be noted that the programs that cause the processing pieces shown in the flowchart of FIGS. 6, 7, 9, and 11-13 to be performed may be stored beforehand in the ROM 62 and so may be read into the program storage area 631 (see FIG. 4) of the RAM 63 when the programs are performed and executed by, for example, the CPU 61, as shown in FIG. 3. Further, it is supposed that various kinds of information necessary to perform the mouse entry processing may be read from the ROM 62, the EEPROM 64, or the external storage device 39 and stored in the setting storage area 632 of the RAM 63 beforehand.

Figure 5:
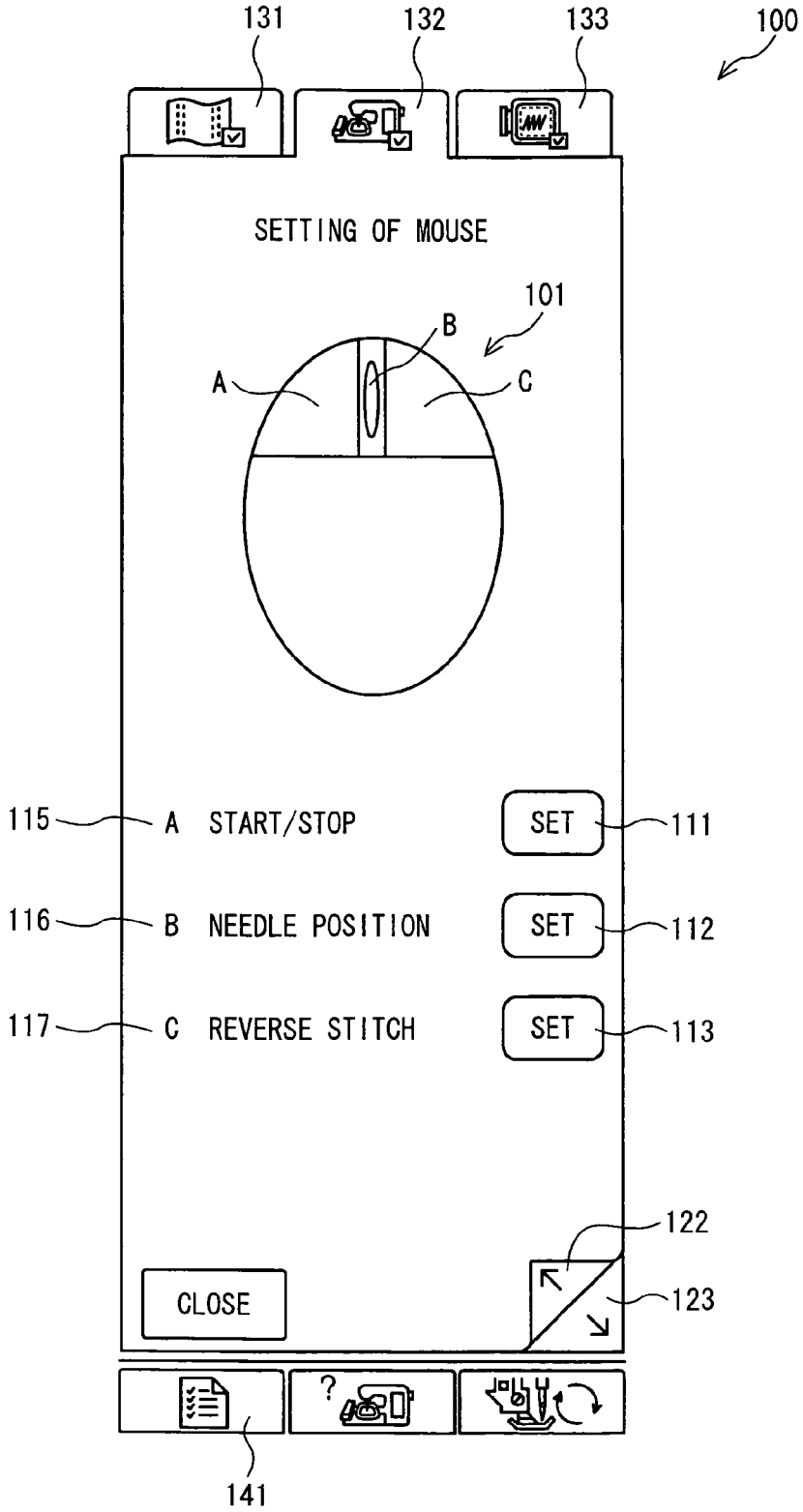
FIG. 5 is an explanatory illustration of a screen which is displayed on a liquid crystal display (LCD).

A screen 100, which may appear on the LCD-15, will be described below with reference to FIG. 5. The screen 100 shown in FIG. 5 may be used to set and confirm a command assigned to an output signal that corresponds to each mouse operation and may be displayed as follows. First, a setting key 141 may be pressed which displays a screen on which standard settings of the sewing machine 1 may be made. Next, out of keys 131-133 that select a target to be set, the key 132 may be pressed that makes settings common to utility stitch pattern/character pattern sewing and embroidery pattern sewing. Further, the setting screen may be switched alternately each time a previous-page key 122 or a next-page key 123 may be pressed, to provide the screen 100 that may correspond to the operation of "mouse setting".

On the screen 100, an illustration 101 of the mouse 27 may appear with its left button 37 displayed by "A", its right button 36 displayed by "C", and its wheel 28 displayed by "B". Further, a command display field 115 below the illustration 101 may display a command of "START/STOP", which may be assigned to an output signal that may be provided in response to the left button operation other than double clicking. The "START/STOP" command may give the same instruction as the sewing start/stop switch 21, which may instruct sewing to be started and stopped. Another command display field 116 may indicate a command of "NEEDLE POSITION", which may be assigned to the wheel 28. The "NEEDLE POSITION" command may instruct driving of the sewing machine motor 79 (see FIG. 3) based on the output signal that corresponds to a rolling amount (angle) and direction of the wheel 28, and may thereby move the needle bar 40 up and down. A command display field 117 may indicate a command of "REVERSE STITCH", which may be assigned to the right button 36. The "REVERSE STITCH" command may instruct to perform reverse stitching during a time when the right button 36 may be held down, thus providing the same instruction as the reverse stitch switch 22. It is to be noted that, in the first embodiment, it is supposed that a total of four commands, that is, the "START/STOP" and "REVERSE STITCH" commands as well as "NEEDLE UP/DOWN" and "THREAD CUT" commands may be assigned to the output signals from the right button 36 and the left button 37. The "NEEDLE UP/DOWN" command may instruct raising or lowering of the needle bar 40 (see FIG. 2) to a predetermined position and the "THREAD CUT" command may instruct cutting of a thread. Further, in the first embodiment, it is supposed that only the above-described "NEEDLE POSITION" command may be assigned to the output signal from the wheel 28.

Further, to the right of the command display field 115, a left button setting key 111 may be displayed, which may set a command to be executed when an output signal that may correspond to the left button operation other than double clicking, for example, is inputted to the control section 60. Similarly, to the right of the command display field 116, a wheel operation setting key 112 may be displayed, which may set a command to be executed when an output signal that corresponds to the wheel operation is inputted to the control section 60. Further, to the right of the command display field 117, a right button setting key 113 may be displayed and may set a command to be executed when an output signal that may correspond the right button operation other than double clicking is inputted to the control section 60. Hereinafter, each of the left button setting key 111, the wheel operation setting key 112, and the right button setting key 113 is generically referred to as a "command setting key".

Figure 6:
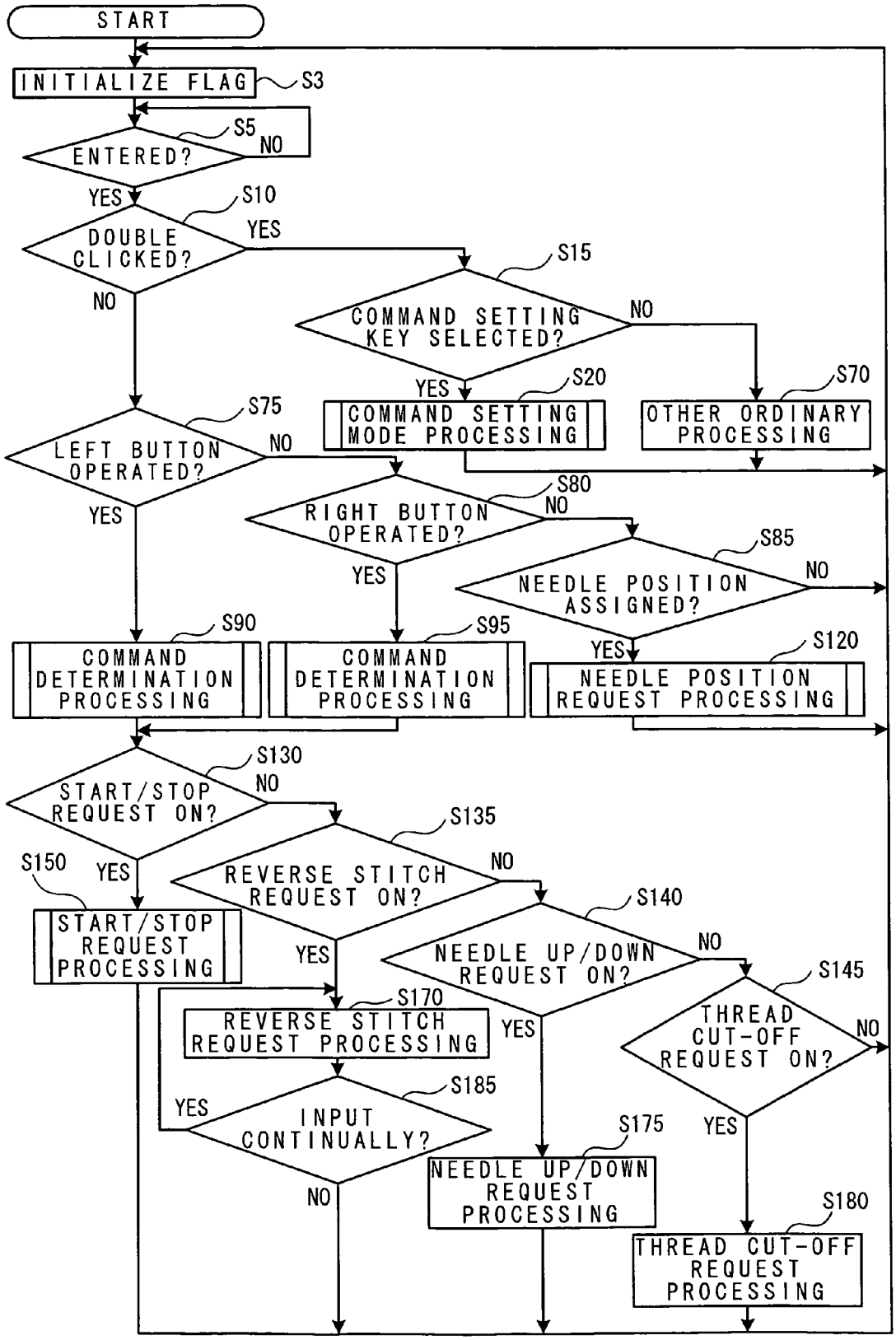
FIG. 6 is a flowchart of mouse entry processing.

Next, the mouse entry processing of the first embodiment will be described below with reference to FIGS. 5-13. As shown in FIG. 6, in the mouse entry processing, first the CPU 61 may initialize various flags stored in the flag storage area 635 (S3). By this processing, for example, the CPU 61 may set OFF flags that may indicate whether there is an instruction to execute a command or not, and may store them in the flag storage area 635. The flags that may indicate whether there is an instruction to execute a command may include, for example, a start/stop request flag, a reverse stitch request flag, a needle up/down request flag, and a thread cut-off request flag. Subsequently, the CPU 61 may determine whether an output signal provided from any one of the right button 36, the left button 37, and the wheel 28 of the mouse 27 may be inputted to the control section 60 (S5). In the first embodiment, processing corresponding to the output signal from the movement detection section 35 of the mouse 27 may be performed in processing different from the mouse entry processing shown in FIG. 6. If an output signal provided from any one of the right button 36, the left button 37, and the wheel 28 of the mouse 27 is not inputted to the control section 60 (NO at S5), the CPU 61 may wait until it determines that the output signal is inputted. On the other hand, if an output signal provided from any one of the right button 36, the left button 37, and the wheel 28 of the mouse 27 is inputted to the control section 60 (YES at S5), the CPU 61 may store this provided output signal in the output signal storage area 633.

Subsequently, the CPU 61 may reference the output signal storage area 633 to determine whether the output signal obtained at S5 corresponds to the double clicking of the right button 36 or the left button 37 (S10). In the first embodiment, for example, depending on whether the output signal corresponds to the double clicking of the right button 36 or the left button 37, a command to be executed may be switched. That is, if the output signal corresponds to the double clicking of the right button 36 or the left button 37 (YES at S10), the CPU 61 may perform ordinary processing. In the ordinary processing, such processing may be performed as to select a variety of commands displayed on the LCD 15. If the output signal does not correspond to the double clicking of the right button 36 or the left button 37 (NO at S10), the CPU 61 may perform processing to execute a command assigned beforehand to an output signal that corresponds to the operation state of each of the operation members. It may thus be possible to distinguish in use between the ordinary processing and the processing to execute a command assigned beforehand, for example, depending on the type of the right button operation or the left button operation. It may also be possible to input an instruction for control over the predetermined operations of the sewing machine 1, without a need to provide a new operation member.

Processing that may be performed when it is determined at S10 that the output signal does not correspond to the double clicking of the right button 36 or the left button 37 (NO at S10) will be described later. If the output signal corresponds to the double clicking of the right button 36 or the left button 37 (YES at S10), the CPU 61 may determine whether any one of the command setting keys 111-113 displayed on the screen 100 of FIG. 5 may be selected, for example, based on whether the output signal corresponds to the double clicking of the right button 36 or the left button 37 (S15). In this processing, for example, if the position of the cursor displayed on the LCD 15 at the time when the right button 36 or the left button 37 is double-clicked agrees with a position where any one of the command setting keys 111-113 is displayed, it may be determined that any one of the command setting keys 111-113 is selected. If none of the command setting keys 111-113 is selected (NO at S15), the CPU 61 may execute any other ordinary processing (S70). In the other ordinary processing, the CPU 61 may execute a command, which is displayed on the LCD 15 and selected by the right button 36 or the left button 37. Subsequently, the CPU 61 may return to S3 to repeat the processing. On the other hand, if any one of the command setting keys 111-113 is selected (YES at S15), the CPU 61 may perform command setting mode processing (S20). In the command setting mode processing, such processing may be performed so as to assign a command to control the operations of the sewing machine 1 to an output signal, which may be provided from the mouse 27. The command setting mode processing will be described later with reference to FIGS. 7 and 8. After S20, the CPU 61 may return to S3 to repeat the processing.

If it is determined at S10 that the output signal detected at S5 does not correspond to the double clicking of the left button 37 or the right button 36 (NO at S10), the CPU 61 may determine which one of the left button operation and the right button operation other than double clicking and the wheel operation, the output signal inputted at S5 corresponds to. Then, the CPU 61 may determine a command to be executed, based on that output signal. Specifically, first the CPU 61 may reference the output signal storage area 633, to determine whether the output signal detected at S5 corresponds to the left button operation other than double clicking (hereinafter the signal corresponding to the left button operation is referred to as a "left-button output signal") (S75). If the output signal is the left-button output signal (YES at S75), the CPU 61 may perform command determination processing related to the left button 37 (S90). In the command determination processing related to the left button 37, a command, which is assigned to the left-button output signal, may be determined. The command determination processing will be described in detail later with reference to FIG. 11. On the other hand, if the output signal is not a left-button output signal (NO at S75), the CPU 61 may reference the output signal storage area 633. Then, the CPU 61 may determine whether the output signal detected at S5 corresponds to the right button operation other than double clicking (hereinafter the signal corresponding to the right button operation is referred to as a "right-button output signal") (S80).

If the output signal is the right-button output signal (YES at S80), the CPU 61 may perform command determination processing related to the right button 36 (S95). The command determination processing related to the right button 36 may determine a command, which is assigned to the right-button output signal, and may be similar to the command determination processing of S90. The command determination processing will be described in detail later with reference to FIG. 11. On the other hand, if the output signal is not a right-button output signal (NO at S80), the output signal input at S5 may be determined to correspond to the wheel operation. Therefore, the CPU 61 may reference the set command storage area 634, to determine whether "NEEDLE POSITION" is set as a command that corresponds to the wheel operation (S85). As described above, in the first embodiment, only the "NEEDLE POSITION" command should be assigned to the wheel operation. If "NEEDLE POSITION" is set as a command that corresponds to the wheel operation (YES at S85), the CPU 61 may perform needle position request processing as processing to execute the command of "NEEDLE POSITION" (S120). The needle position request processing will be described in detail later with reference to, for example, FIG. 12. After the needle position request processing (S120), the CPU 61 may return to S3 to repeat the processing. On the other hand, if "NEEDLE POSITION" is not set as a command that corresponds to the wheel operation (NO at S85), the wheel operation should not be assigned a command. Therefore, the CPU 61 may not perform processing that corresponds to the wheel operation and instead, may return to S3 to repeat the processing.

After S90 or S95, the CPU 61 may perform processing to execute a command that may correspond to a left-button output signal or a right-button output signal. The command that may correspond to a left-button output signal or a right-button output signal may be determined in the command determination processing, which may be performed at S90 or S95. In the command determination processing, as described later with reference to, for example, FIG. 11, the CPU 61 may set a flag to ON that may correspond to a determined command. The CPU 61 may reference the flag storage area 635, to determine whether the start/stop request flag is ON (S130). If the start/stop request flag is ON (YES at S130), the CPU 61 may perform start/stop request processing (S150). In the start/stop request processing, depending on the driven state of the sewing machine motor 79, control may be conducted to start or stop the sewing machine motor 79. The start/stop request processing will be described in detail later with reference to, for example, FIG. 13. After S150, the CPU 61 may return to S3 to repeat the processing. On the other hand, if the start/stop request flag is not ON (NO at S130), the CPU 61 may reference the flag storage area 635, to determine whether the reverse stitch request flag is ON (S135).

If the reverse stitch request flag is ON (YES at S135), the CPU 61 may perform reverse stitch request processing (S170). In the reverse stitch request processing, reverse stitches may be formed. The CPU 61 may determine whether the output signal detected at S5 is inputted continually (S185) and, as far as the output signal detected at S5 is inputted continually (YES at S185), may perform the reverse stitch request processing to form reverse stitches (S170). If the output signal detected at S5 is no longer inputted continually (NO at S185), the CPU 61 may return to S3 to repeat the processing. On the other hand, if the reverse stitch request flag is not ON (NO at S135), the CPU 61 may reference the flag storage area 635, to determine whether the needle up/down request flag is ON (S140).

If the needle up/down request flag is ON (YES at S140), the CPU 61 may perform needle up/down request processing (S175). In the needle up/down request processing, the CPU 61 may control the drive circuit 72 (see FIG. 3), to drive the sewing machine motor 79 (see FIG. 3), and may thereby perform processing to move up and down the needle bar 40 (see FIG. 2) in accordance with the vertical position of the sewing needle 29 (see FIGS. 1 and 2). In the first embodiment, for example, if the sewing needle 29 is lower in the vertical direction than a work cloth (not shown) when the output signal of a mouse operation is inputted, the CPU 61 may move the needle bar 40 to the highest position. On the other hand, if the sewing needle 29 is higher in the vertical direction than the work cloth, the CPU 61 may move the needle bar 40 to the lowest position. The vertical position of the sewing needle 29, that is, the vertical position of the needle bar 40 may be detected by the drive shaft angle sensor 32 (see FIG. 3). To move the needle bar 40, the CPU 61 may control the drive circuit 72 so that the sewing machine motor 79 may be driven by a predetermined rotation amount. Subsequently, the CPU 61 may return to S3 to repeat the processing. On the other hand, if the needle up/down request flag is not ON (NO at S140), the CPU 61 may reference the flag storage area 635, and may determine whether the thread cut-off request flag is ON (S145). If the thread cut-off request flag is ON (YES at S145), the CPU 61 may perform thread cut-off request processing (S180). In the thread cut-off request processing, the CPU 61 may stop the sewing machine motor 79 and then may drive a thread cut-off mechanism (not shown) to cut off a needle thread and a bobbin thread. Subsequently, the CPU 61 may return to S3 to repeat the processing. On the other hand, if the thread cut-off request flag is not ON (NO at S145), the CPU 61 may return to S3 to repeat the processing.

Through the above mouse entry processing, the CPU 61 may assign a command to control the operations of the sewing machine 1 to an output signal, which may be provided from any one of the right button 36, the left button 37, and the wheel 28, which may be the operation members of the mouse 27. Then, for example, if an output signal corresponding to the operation state of any one of these operation members is inputted to the control section 60, the CPU 61 may execute a command, which may be assigned to that output signal. Next, the command setting mode processing, which may be performed in the mouse entry processing shown in FIG. 6, will be described below with reference to, for example, FIGS. 5 and 7.

Figure 7:
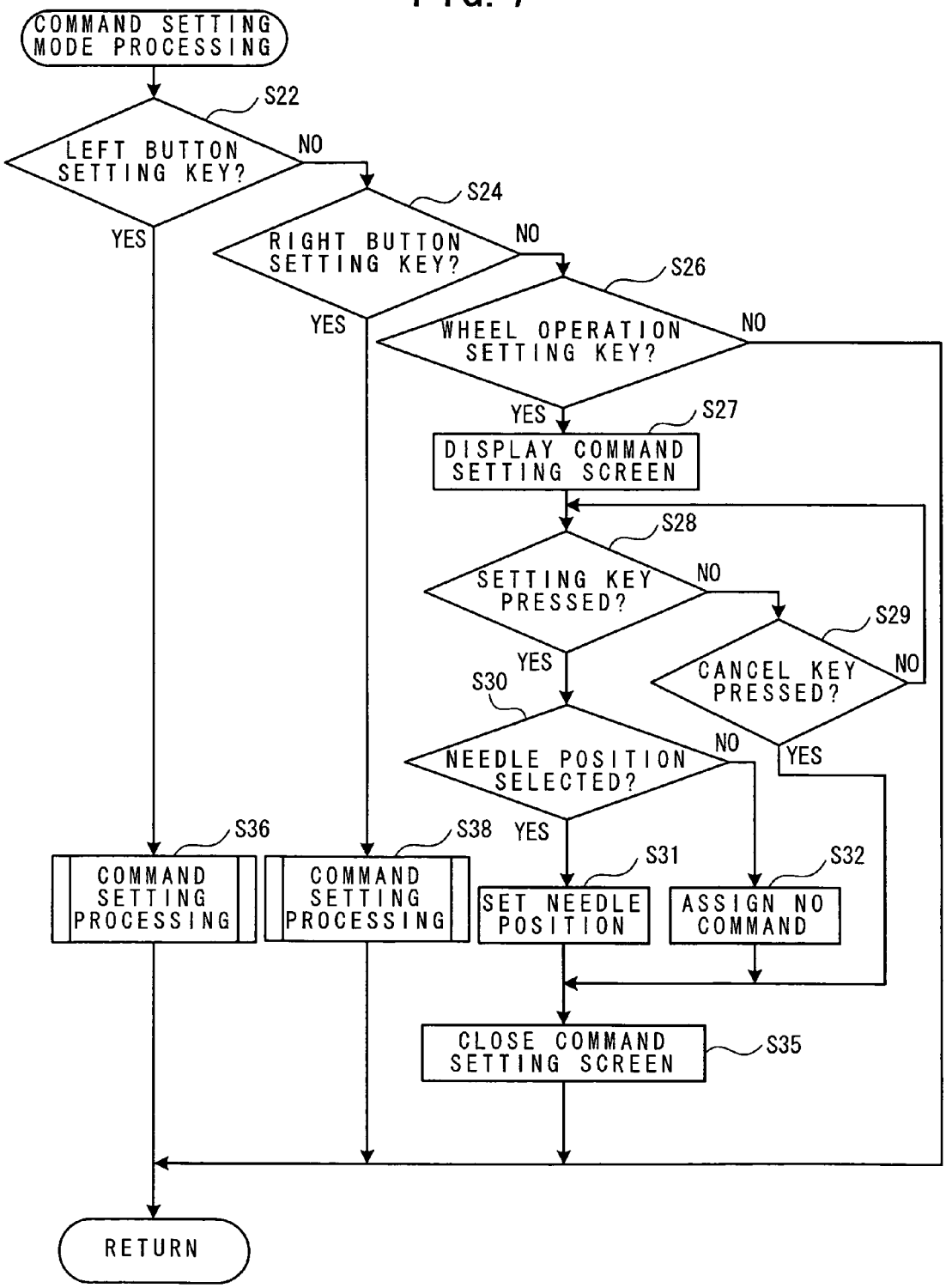
FIG. 7 is a flowchart of a command setting mode processing which is performed in the mouse entry processing of FIG. 6.

As shown in FIG. 7, in the command setting mode processing, first the CPU 61 may determine whether the left button setting key 111 (see FIG. 5) is selected, for example, based on the output signal detected at S5 of FIG. 6 (S22). In this processing, for example, if the position of the cursor displayed on the LCD 15 at the time when the right button 36 or the left button 37 is double-clicked agrees with a position where the left button setting key 111 is displayed, the CPU 61 may determine that the left-button setting key 111 is selected. If the left button setting key 111 is selected (YES at S22), the CPU 61 may execute command setting processing relating to the left button (S36). In the command setting processing relating to the left button, the CPU 61 may perform processing to assign a command specified by the user to the left-button operation other than double clicking. The command setting processing will be described later with reference to, for example, FIG. 9. On the other hand, if the left button setting key 111 is not selected (NO at S22), the CPU 61 may determine whether the right button setting key 113 is selected by the output signal detected at S5 (S24). If the right button setting key 113 is selected (YES at S24), the CPU 61 may execute the command setting processing relating to the right button (S38). In the command setting processing relating to the right button, the CPU 61 may perform processing to assign a command to the right-button operation other than double clicking. The command setting processing relating to the right button, which may be similar to the command setting processing relating to the left button that may be performed at S36, will be described later with reference to, for example, FIG. 9. On the other hand, if the right button setting key 113 is not selected (NO at S24), the CPU 61 may determine whether the wheel operation setting key 112 is selected by the output signal detected at S5 (S26). If the wheel operation setting key 112 is not selected (NO at S26), the CPU 61 may end the command setting mode processing and may return to S3 for the command entry processing shown in FIG. 6, to repeat the processing.

Figure 8:
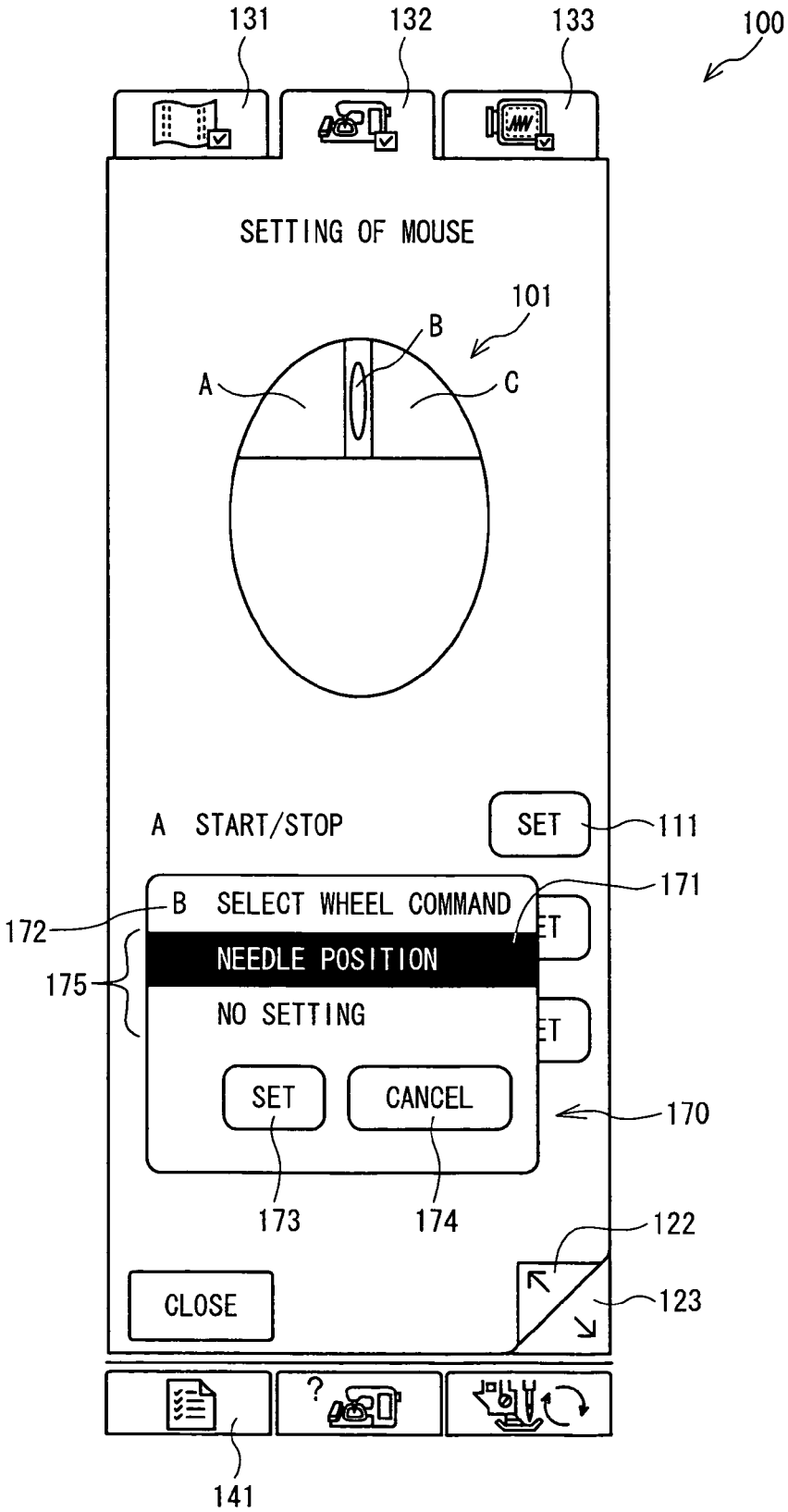
FIG. 8 is an explanatory illustration of a command setting screen which is displayed in the command setting mode processing of FIG. 7.

On the other hand, if the wheel operation setting key 112 is selected by the user (YES at S26), the CPU 61 may display a command setting screen on the LCD 15 for an output signal that may correspond to the wheel operation (which output signal corresponding to the wheel operation is hereinafter referred to as a "wheel output signal" simply) (S27). If the command setting key is the wheel operation setting key 112, the CPU 61 may display a command setting screen 170 such as shown in FIG. 8. The command setting screen 170 will be described below with reference to, for example, FIG. 8. As shown in FIG. 8, at the upper part of the command setting screen 170, a command assignment target display field 172 may be provided in which "B" may be displayed, which indicates the wheel 28 to which a command is to be assigned. Below the command assignment target display field 172, a command candidate field 175 may be provided that displays a list of candidates of the command, and a command may be assigned to the wheel output signal. In the command candidate field 175, "NEEDLE POSITION" and "NO SETTING", which means not assigning a command to the wheel operation, may be displayed. Among the commands displayed in the command candidate field 175, "NEEDLE POSITION", which may be black-and-white reverse displayed by a cursor 171, may be tentatively selected as a command to be assigned to the wheel operation. At the lower left part of the command setting screen 170, a setting key 173 may be displayed. If the setting key 173 is selected, a command, which may be black-and-white reverse displayed by a cursor 171 (hereinafter a command which is black-and-white reverse displayed by a cursor is referred to as a "selected command"), may be assigned to the wheel operation. Further, at the lower right part of the command setting screen 170, a cancel key 174 may be displayed. If the cancel key 174 is selected, processing to change a command assigned to the wheel operation may be stopped.

Further, the command setting mode processing will be described below with reference to, for example, FIG. 7. Subsequent to S27, the CPU 61 may determine whether the user has inputted the output signal by the mouse operation or panel operation to thereby press the setting key 173 (S28). If the setting key 173 is not pressed (NO at S28), the CPU 61 may determine whether the cancel key 174 is pressed by the user (S29). If the cancel key 174 is not pressed (NO at S29), the CPU 61 may return to S28 to wait until the setting key 173 or the cancel key 174 is pressed by the user. On the other hand, if the cancel key 174 is pressed by the user (YES at S29), the CPU 61 may stop processing to set a command to the wheel operation and may close the command setting screen 170 (S35). Subsequently, the CPU 61 may return to S3 of the mouse entry processing shown in FIG. 6 to repeat the processing.

If it is determined at S28 that the setting key 173 is pressed by the user (YES at S28), the CPU 61 may perform processing to identify the selected command, and may assign it to the wheel operation, may be displayed. For example, the CPU 61 may first determine whether the selected command is "NEEDLE POSITION" (S30). If the selected command is "NEEDLE POSITION" (YES at S30), the CPU 61 may store, in the set command storage area 634, "NEEDLE POSITION" as a command that may correspond to the wheel output signal (S31). On the other hand, if the selected command is not "NEEDLE POSITION" (NO at S30), this selected command may be "NO SETTING". Therefore, the CPU 61 may store, in the set command storage area 634, "NO SETTING", which may not assign a command to the wheel output signal (S32). Subsequent to S31 or S32, the CPU 61 may close the command setting screen 170 (S35), may end the command setting mode processing, and may return to S3 of the mouse entry processing shown in FIG. 6 to repeat the processing.

Figure 9:
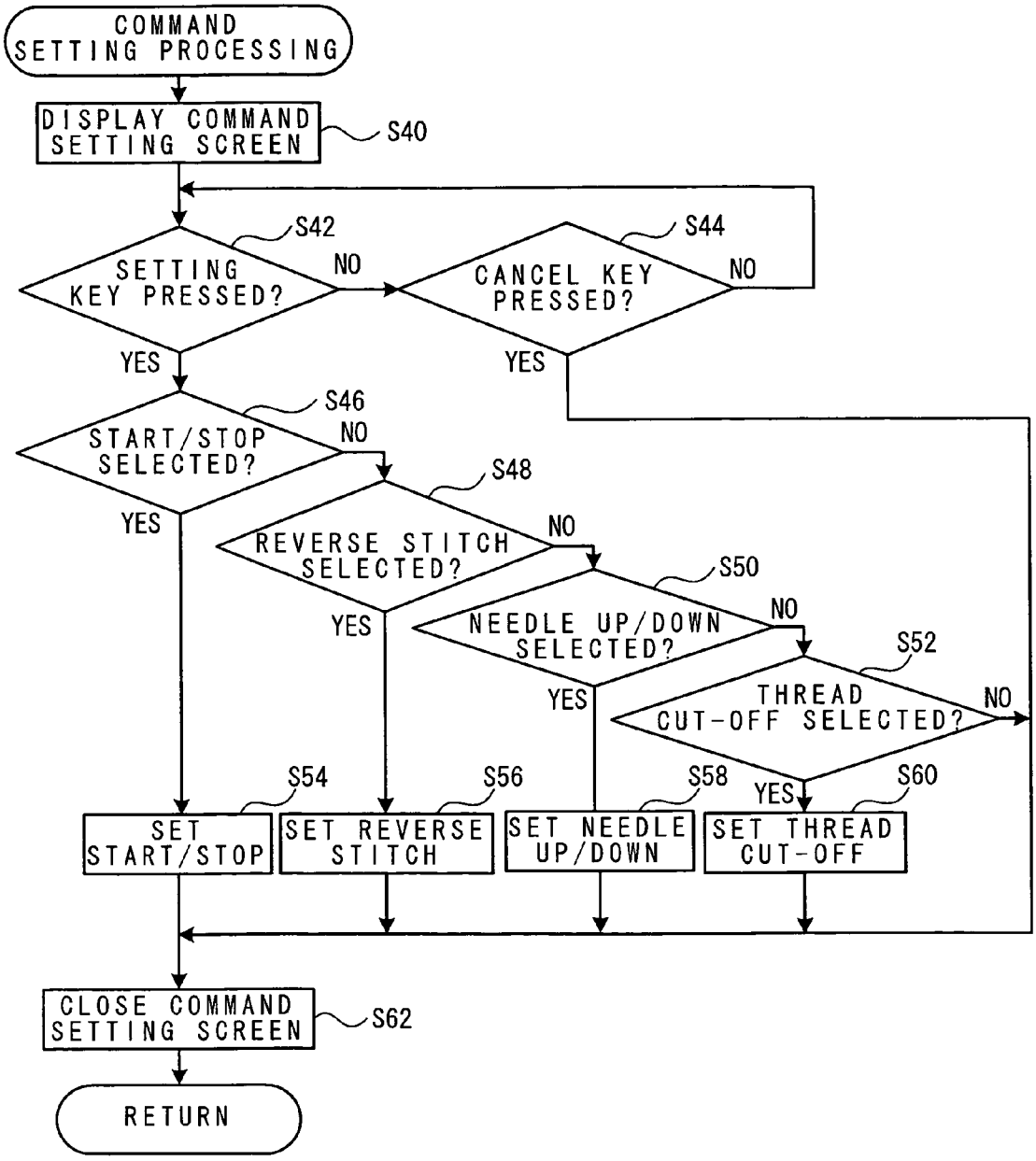
FIG. 9 is a flowchart of a command setting processing which is performed in the command setting mode processing of FIG. 7.
Figure 10:
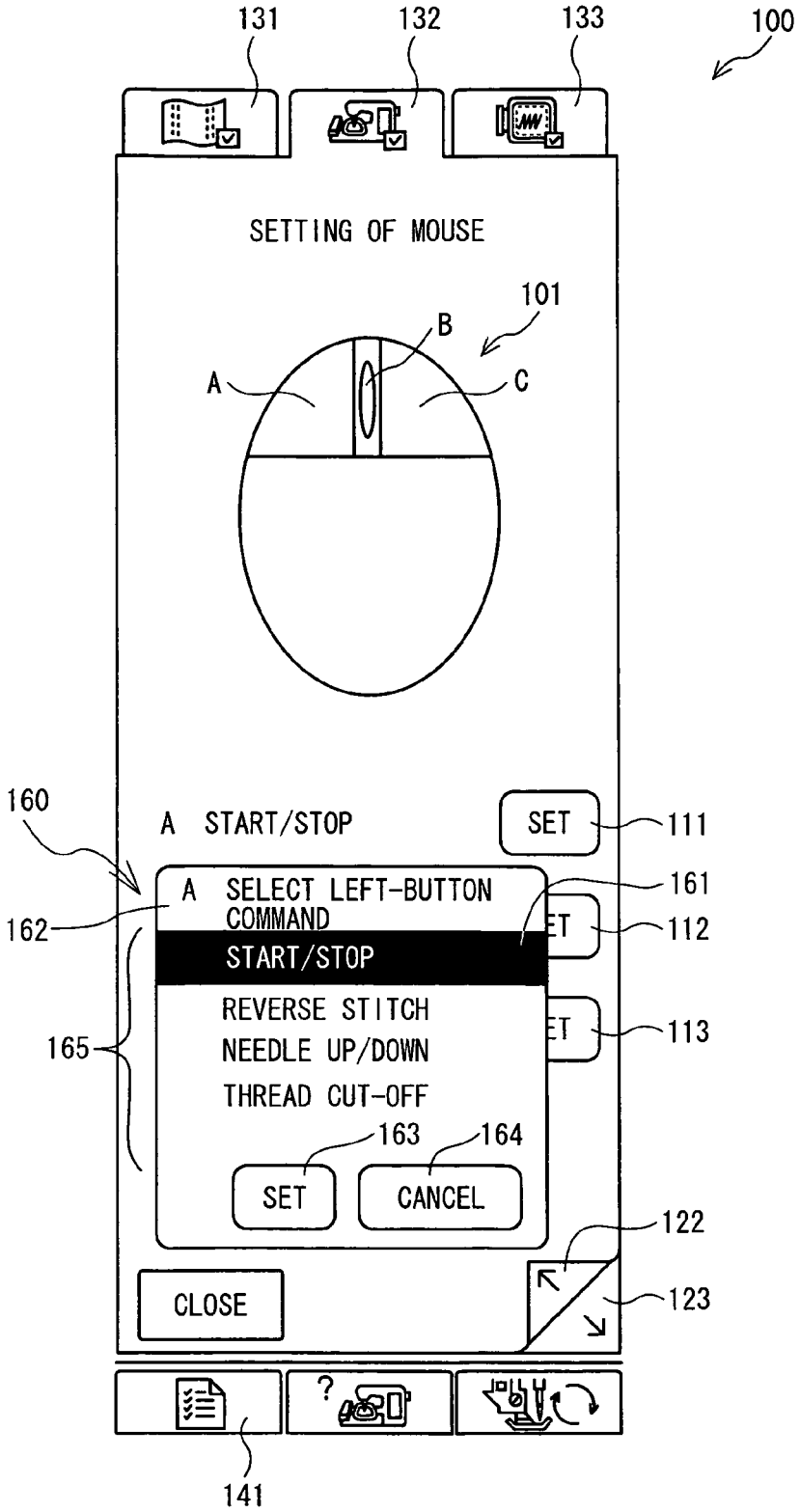
FIG. 10 is an explanatory illustration of the command setting screen which is displayed in the command setting processing of FIG. 9.

As described above, the CPU 61 may perform the command setting mode processing of S20 in the mouse entry processing shown in FIG. 6. Next, the command setting processing which may be performed in the command setting mode processing shown in FIG. 7, will be described below with reference to FIG. 9. As one example, such a case will be described below as to perform the command setting processing in relation to the left button operation other than double clicking to be performed at S36. It is to be noted that this may also hold true with the case of performing the command setting processing relating to the right button to be performed at S38. The command setting processing shown in FIG. 9 may be performed to assign a command to a left button output signal or a right-button output signal. When assigning a command to the left-button output signal, the CPU 61 may first display a command setting screen that corresponds to a command setting key (S40). If the command setting key is the left-button setting key 111, the CPU 61 may display such a command setting screen 160 as shown in FIG. 10.

The command setting screen 160 will be described below with reference to, for example, FIG. 10. As shown in FIG. 10, at the upper part of the command setting screen 160, a command assignment target display field 162 may be provided in which "A" is displayed that may indicate the left button 37 (see FIG. 1) to which a command is to be assigned. Below the command assignment target display field 162, a command candidate field 165 may be provided. In the command candidate field 165, "START/STOP", "REVERSE STITCH", "NEEDLE UP/DOWN", and "THREAD CUT-OFF" may be displayed as candidates of the command to be assigned to the left button output signal. "START/STOP", which may be black-and-white reverse displayed by the cursor 161 currently in the command candidate field 165, may be tentatively selected as a command to be assigned to the left-button output signal. Further, at the lower left part of the command setting screen 160, a setting key 163 may be displayed. If the setting key 163 is selected, a selected command may be assigned to the left-button output signal. At the lower right part of the command setting screen 160, a cancel key 164 may be displayed. If the cancel key 164 is selected, the command setting processing may be stopped.

Further, the command setting processing will be described below with reference to, for example, FIG. 9. Subsequent to S40, the CPU 61 may determine whether the setting key 163 is pressed by the user (S42). If the setting key 163 is not pressed (NO at S42), the CPU 61 may determine whether the cancel key 164 is pressed by the user (S44). If the cancel key 164 is not pressed (NO at S44), the CPU 61 may return to S42 to wait until the setting key 163 or the cancel key 164 is pressed by the user. If the cancel key 164 is pressed by the user (YES at S44), the CPU 61 may stop processing to assign a command to the left-button output signal and may close the command setting screen 160 (S62). Subsequently, the CPU 61 may end the command setting processing shown in FIG. 9 and may return to the command setting mode processing shown in FIG. 7.

On the other hand, if it is determined at S42 that the setting key 163 is pressed by the user (YES at S42), the CPU 61 may perform processing to identify a selected command displayed on the command setting screen 160 and assign it to the left-button output signal. The processing to identify a selected command on the command setting screen 160 may be performed on the position of the cursor 161 and those of the commands at a time when the setting key 163 is pressed, for example. For example, the CPU 61 may first determine whether the selected command is "START/STOP" (S46). If the selected command is "START/STOP" (YES at S46), the CPU 61 may store, in the set command storage area 634, "START/STOP" as a command that may correspond to the left-button output signal (S54). On the other hand, if the selected command is not "START/STOP" (NO at S46), the CPU 61 may determine whether the selected command is "REVERSE STITCH" (S48). If the selected command is "REVERSE STITCH" (YES at S48), the CPU 61 may store, in the set command storage area 634, "REVERSE STITCH" as a command that may correspond to the left-button output signal (S56). On the other hand, if the selected command is not "REVERSE STITCH" (NO at S48), the CPU 61 may determine whether the selected command is "NEEDLE UP/DOWN" (S50).

If the selected command is "NEEDLE UP/DOWN" (YES at S50), the CPU 61 may store, in the set command storage area 634, "NEEDLE UP/DOWN" as a command that corresponds to the left-button output signal (S58). On the other hand, if the selected command is not "NEEDLE UP/DOWN" (NO at S50), the CPU 61 may determine whether the selected command is "THREAD CUT-OFF" (S52). If the selected command is "THREAD CUT-OFF" (YES at S52), the CPU 61 may store, in the set command storage area 634, "THREAD CUT-OFF" as a command that may correspond to the left-button output signal (S60). On the other hand, if the selected command is not "THREAD CUT-OFF" (NO at S52), the CPU 61 may close the command setting screen 160 (S62) and may end the command setting processing. Subsequently, the CPU 61 may return to the command setting mode processing shown in FIG. 7 and, further, may return to S3 in the mouse entry processing shown in FIG. 6 to repeat the processing.

Subsequent to S54, S56, S58, or S60, the CPU 61 may close the command setting screen 160 (S62) and may end the command setting processing. Subsequently, the CPU 61 may return to the command setting mode processing shown in FIG. 7 and, further, may return to S3 in the mouse entry processing shown in FIG. 6 to repeat the processing. As described above, the CPU 61 may perform the command setting processing of S36 or S38 in the command setting mode processing shown in FIG. 7.

Next, the command determination processing, which may be performed at S90 or S95 in the mouse entry processing shown in FIG. 6, will be described below using as an example of the command determination processing that may be performed on the left button 37, with reference to, for example, FIG. 11. The same processing may also be performed for the command determination processing on the right button 36.

Figure 11:
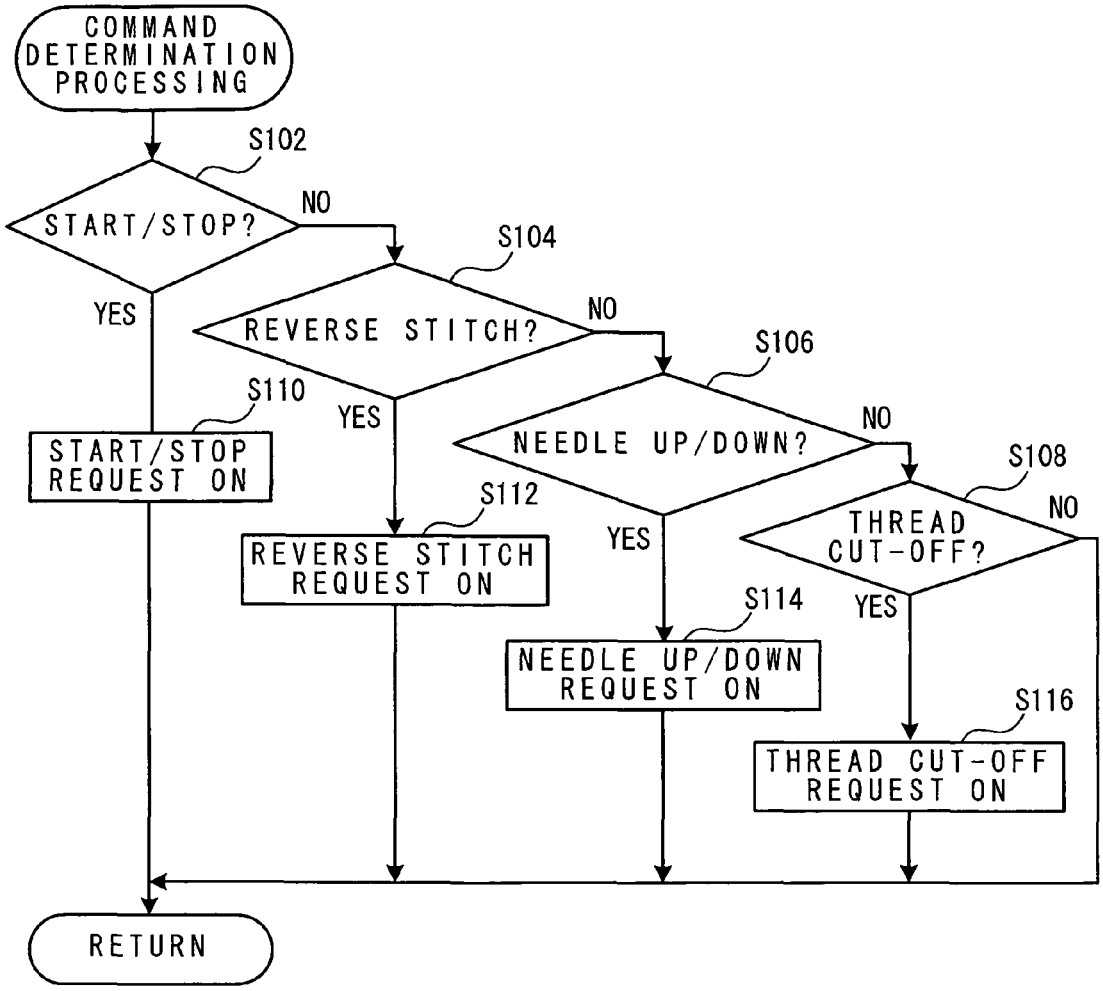
FIG. 11 is a flowchart of a command determination processing which is performed in the mouse entry processing of FIG. 6.

In the command determination processing shown in FIG. 11, the CPU 61 may first reference the set command storage area 634 and may perform processing to identify a command, which may be assigned to a left-button output signal. For example, the CPU 61 may determine whether the command assigned to the left-button output signal is "START/STOP" (S102). If the command assigned to the left-button output signal is "START/STOP" (YES at S102), the CPU 61 may set ON the start/stop request flag and may store it in the flag storage area 635 (S110). On the other hand, if the command assigned to the left-button output signal is not "START/STOP" (NO at S102), the CPU 61 may determine whether the command assigned to the left-button output signal is "REVERSE STITCH" (S104). If the command assigned to the left-button output signal is "REVERSE STITCH" (YES at S104), the CPU 61 may set ON the reverse stitch request flag and may store it in the flag storage area 635 (S112). On the other hand, if the command assigned to the left-button output signal is not "REVERSE STITCH" (NO at S104), the CPU 61 may determine whether the command assigned to the left-button output signal is "NEEDLE UP/DOWN" (S106).

If the command assigned to the left-button output signal is "NEEDLE UP/DOWN" (YES at S106), the CPU 61 may set ON the needle up/down request flag and may store it in the flag storage area 635 (S114). On the other hand, if the command assigned to the left-button output signal is not "NEEDLE UP/DOWN" (NO at S106), the CPU 61 may determine whether the command assigned to the left-button output signal is "THREAD CUT-OFF" (S108). If the command assigned to the left-button output signal is "THREAD CUT-OFF" (YES at S108), the CPU 61 may set ON the thread cut-off request flag and may store it in the flag storage area 635 (S116). On the other hand, if the command assigned to the left-button output signal is not "THREAD CUT-OFF" (NO at S108), the CPU 61 may end the command determination processing and may return to the mouse entry processing shown in FIG. 6.

Subsequent to S110, S112, S114, or S116, the CPU 61 may end the command determination processing and may return to the mouse entry processing shown in FIG. 6. Based on each of the above-described request flags that may be set in the command determination processing, a command that may correspond to an output signal detected at S5 may be executed in the processing of S130 and the subsequent in the mouse entry processing shown in FIG. 6.

Figure 12:
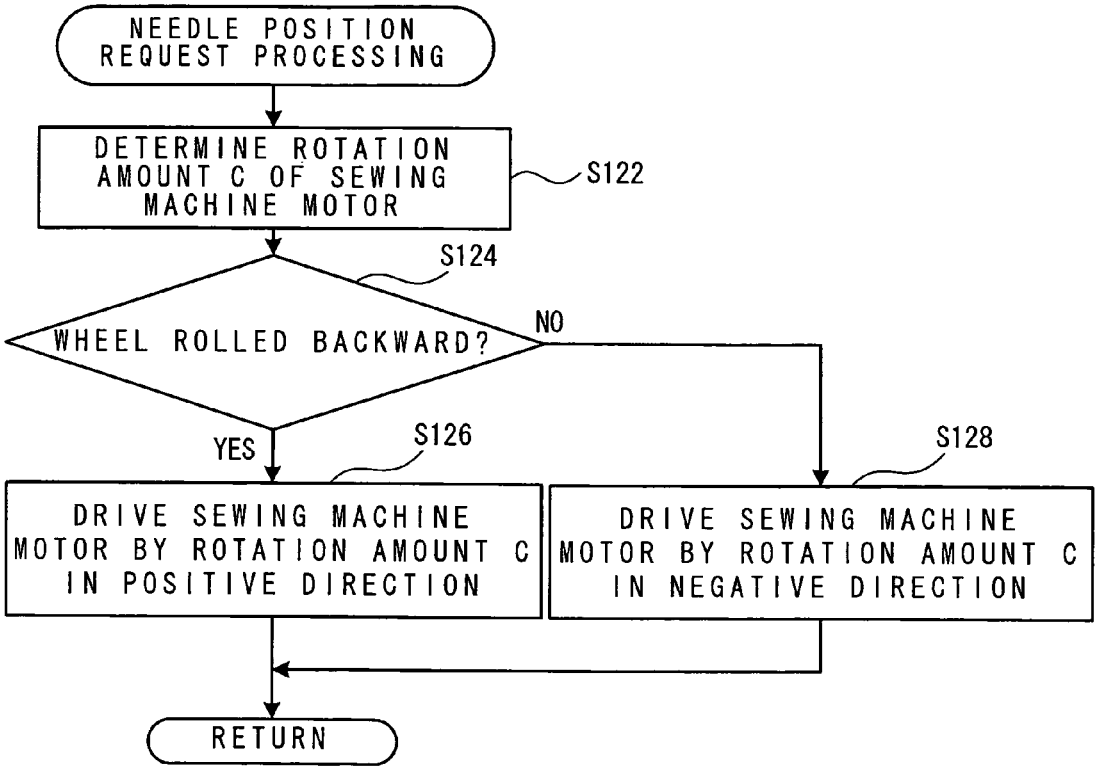
FIG. 12 is a flowchart of a needle position request processing which is performed in the mouse entry processing of FIG. 6.

Next, the needle position request processing, which may be performed at S120 in the mouse entry processing shown in FIG. 6, will be described below with reference to FIG. 12. As shown in FIG. 12, first the CPU 61 may reference the output signal storage area 633 and the setting storage area 632. Then, the CPU 61 may determine a rotation amount C of the sewing machine motor 79, which is instructed by an output signal based on a wheel operation detected at S5 in FIG. 6, and may store it in the calculated value storage area 636 (S122). The relationship between the output signal and the rotation amount C of the sewing machine motor 79 may be stored in the ROM 62 beforehand and read in the setting storage area 632 of the RAM 63 when the needle position request processing may be performed.

Subsequently, the CPU 61 may reference the output signal storage area 633 to determine whether an output signal detected at S5 corresponds to backward rolling (S124). This processing may be performed, for example, to change the rotation direction of the drive shaft 51 (see FIG. 2) in accordance with the rolling direction of the wheel 28. The drive shaft 51 may be rotated in different directions, for example, a positive direction and a negative direction, by the sewing machine motor 79. If the sewing machine motor 79 rotates the drive shaft 51 in the positive direction, as viewed from the right side surface of the sewing machine 1, the drive shaft 51 may be rotated counterclockwise. If the sewing machine motor 79 rotates the drive shaft 51 in the negative direction, as viewed from the right side surface of the sewing machine 1, the drive shaft 51 may be rotated clockwise.

In the first embodiment, if the wheel 28 is rolled backward (YES at S124), the CPU 61 may control the drive circuit 72 (see FIG. 3) so as to drive the sewing machine motor 79 (see FIG. 3) in the positive direction by the rotation amount C determined at S122 (S126). On the other hand, if the wheel 28 is not rolled backward, that is, if it is rolled forward (NO at S124), the CPU 61 may drive the sewing machine motor 79 in the negative direction by the rotation amount C determined at S122 (S128). Subsequent to S126 or S128, the CPU 61 may end the needle position request processing and returns to S3 in the mouse entry processing shown in FIG. 6 to repeat the processing. In such a manner, the needle position request processing may be performed.

Figure 13:
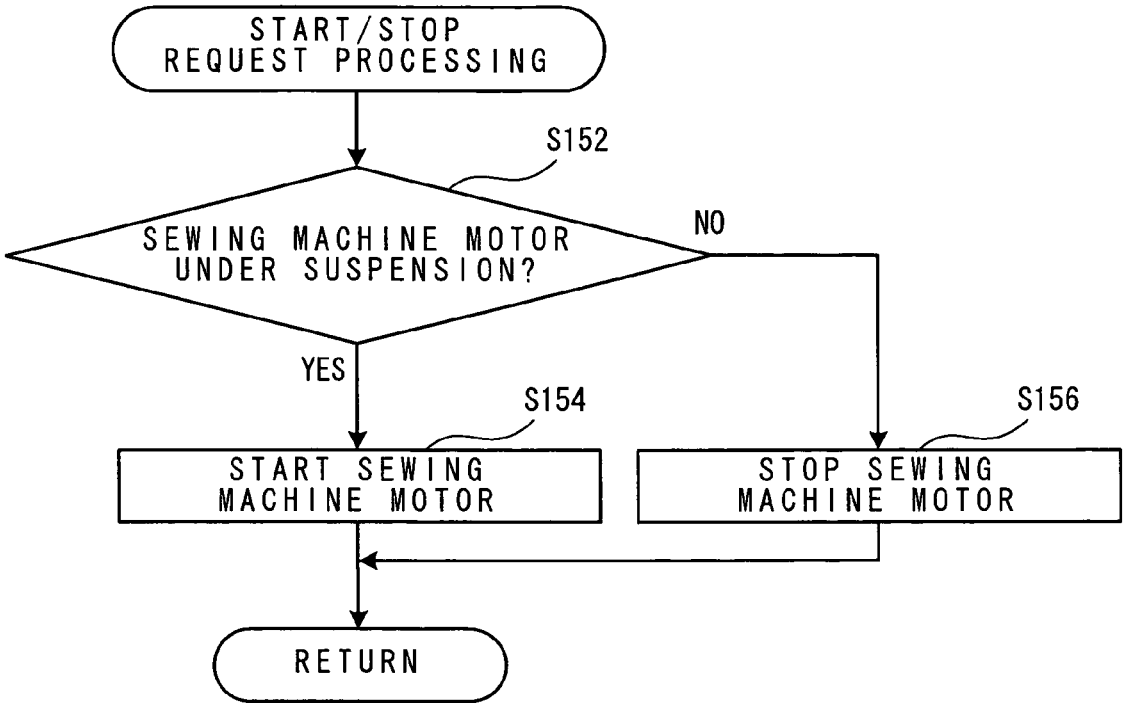
FIG. 13 is a flowchart of a start/stop request processing which is performed in the mouse entry processing of FIG. 6.

Next, the start/stop request processing, which is performed at S150 in the mouse entry processing shown in FIG. 6, will be described below with reference to, for example, FIG. 13. As shown in FIG. 13, in the start/stop request processing, the CPU 61 may first determine whether the sewing machine motor 79 is under suspension (S152). This processing may be performed to start or stop the sewing machine motor 79 in accordance with the driving state of the sewing machine motor 79. Whether the sewing machine motor 79 is under suspension is determined, for example, on the basis of a flag that is set in sewing processing that may be performed separately from the mouse entry processing so that it may indicate the driving state of the sewing machine motor 79. If the sewing machine motor 79 is under suspension (YES at S152), the CPU 61 may control the drive circuit 72 so as to start the sewing machine motor 79 (S154). On the other hand, if the sewing machine motor 79 is not under suspension (NO at S152), the CPU 61 may control the drive circuit 72 so as to stop the driving of the sewing machine motor 79 (S156). Subsequent to S154 or S156, the CPU 61 may end the start/stop request processing and may return to S3 in the mouse entry processing shown in FIG. 6 to repeat the processing. As described in detail, the CPU 61 may perform the mouse entry processing of the first embodiment in the sewing machine 1.

According to the sewing machine 1 of the first embodiment, the mouse 27 that may provide an output signal in accordance with the operation state of the left button 37, the right button 36, and the wheel 28 may be provided separately from the sewing machine body 2. Hence, the user may dispose the mouse 27 to a desired position where the user is easy to operate it. This may facilitate the entry of a command as compared to the case of entering a command to instruct the operations of the sewing machine 1 by pressing the various switches 21-25 on the front surface of the arm portion 13 of the sewing machine 1 or by operating the touch panel, for example, on the screen displayed on the LCD 15. Further, one of plural kinds of commands may be selected so as to be assigned to an output signal, by referencing which command, for example, a command that corresponds to an output signal provided by the mouse 27 may be determined. Therefore, by appropriately assigning a command taking into account its frequency of use, it may be possible to improve the operability in inputting an instruction to control the predetermined operations of the sewing machine 1. Also, by reselecting the assignment of the commands in accordance with a sewing work appropriately, different instructions may be inputted flexibly through the single mouse 27 without providing a new operation member. Therefore, it may be possible to consolidate the buttons, for example, that may otherwise be mounted on the sewing machine body 2 to input instructions for controlling the predetermined operations of the sewing machine 1, into the mouse 27.

Further, when the "START/STOP" command is assigned to any one of the operation members of the mouse 27 and if that "START/STOP" command is entered, control may be conducted to start or stop the sewing machine motor 79 in accordance with the driving state of the sewing machine motor 79. As described above, the mouse 27 may be disposed to a desired position where the user is easy to operate it. Therefore, by inputting the instructions to start and stop sewing by using the operation device disposed to an appropriate position, it may be possible to easily instruct the sewing to be started and stopped, and thereby the sewing work may progress smoothly.

Further, when the "NEEDLE POSITION" command is assigned to any one of the operation members of the mouse 27 and if that "NEEDLE POSITION" command is entered through the mouse operation, control may be conducted to move the needle bar 40 upward or downward by as much as indicated by that needle position. Conventionally, similar processing has been performed as needle position request processing by means of the rotation of the pulley 41 mounted on the right side surface of the sewing machine 1. In contrast, in the first embodiment, by such a simple operation as rolling the wheel 28 of the mouse 27 forward or backward, the drive shaft 51 may be revolved to move the needle bar 40 to which the sewing needle 29 may be attached to a desired vertical position. Further, because the mouse 27 may be disposed to a desired position where the user is easy to operate it, it may be possible to input an instruction to move the needle bar 40 to a desired position, by disposing the mouse 27 to an appropriate position. Further, the wheel 28 may need less power in operation than the pulley 41 and so may be operated handily, and thereby the burdens on the sewing work may be mitigated. Moreover, the wheel 28 and the pulley 41 may be common to each other in having a disk-like shape may also be common to each other in rotating their disk-shaped members forward or backward to move the needle bar 40 vertically. Therefore, even the user accustomed to the operation of the conventional sewing machines may feel comfortable in using the mouse 27 to input the instructions to move the needle bar 40.

It is to be noted that the above-detailed first embodiment may be changed variously. For example, the first embodiment may use the mouse 27 that may be equipped with the wheel 28 and may be connected to the sewing machine body 2 with a cable. However, the present disclosure is not limited to it. The operation device that may be employed may be provided separately from the sewing machine body 2 and may provide an output signal that may correspond to at least one of operation member thereof. For example, a mouse may not be equipped with a wheel and a mouse, which provide an output signal wirelessly. Various switches such as a game controller, a digitizer and a tablet, and pointing devices such as a track ball or a joystick may be employed. Similarly, although the first embodiment may use the mouse 27 or the touch panel 26 to select a command to be assigned to the output signal of the mouse 27, the present disclosure is not limited to it. For example, anything that interfaces with the user may be employed, such as track balls, joysticks, and various switches, such as a game controller, etc.

Further, in the first embodiment, the user may set a command to be assigned to each of the operation members of the mouse 27. However, the present disclosure is not limited to it. For example, the commands assigned to the operation members of the mouse 27 may be fixed or the predefined commands may be switched automatically in accordance with the usage states of the sewing machine 1, such as a sewing state or an embroidery pattern editing state. Further, although the first embodiment may set a command to be assigned to each of the operation members of the mouse 27, the present disclosure is not limited to it. For example, a combination of commands to be assigned to the operation members may be registered beforehand and used to set commands to be assigned to a plurality of the operation members at a time.

Although in the first embodiment, commands which control the operations of the sewing machine 1 may be assigned to output signals that may correspond to the operation states of the left button 37, the right button 36, and the wheel 28 of the mouse 27, the output signals to which the commands may be assigned are not limited to those in the case of the first embodiment. For example, the commands may be assigned only to any one of the left button 37, the right button 36, and the wheel 28 of the mouse 27 or arbitrary two out of them. Although the first embodiment has not assigned a command to an output signal of the movement detection section 35 of the mouse 27, a command may be assigned to the output signal of the movement detection section 35.

Further, in the first embodiment, commands that control the operations of the sewing machine 1 may be assigned to output signals in a case where, for example, an operation other than double clicking has been made on the left button 37 or the right button 36 of the mouse 27, and thereby the command assigned beforehand may be executed. The method of assigning commands to the output signals according to the type of output signals is not limited to that of the first embodiment, so that any other assignment method may be employed. For example, different commands may be assigned to the different operations of double clicking, single clicking, and continuous pressing on the left button 37 or the right button 36. Alternatively, the same command may be assigned regardless of the different operations, such as double clicking and the other operations on the left button 37 or the right button 36. Further, the left button 37 and the right button 36 may have different operation states to which the commands are to be assigned.

Further, although the first embodiment has exemplified "START/STOP", "REVERSE STITCH", "NEEDLE UP/DOWN", and "THREAD CUT-OFF" as possible candidates for commands to be assigned to the right button 36 or the left button 37, the present disclosure is not limited to it. Any other command may be assigned that controls the operations of the sewing machine 1. Similarly, although "NEEDLE POSITION" has been exemplified as a possible candidate for a command to be assigned to the wheel 28, the present disclosure is not limited to it. Any other command may be assigned that controls the operations of the sewing machine 1. Further, a plurality of commands that may be executed simultaneously or consecutively may be assigned to one output signal or the same command may be assigned to the different operation members.

Further, although the first embodiment may be described with reference to a case where the present disclosure has been applied to the sewing machine 1 equipped with only one needle bar, the present disclosure is not limited to it. The present disclosure may be applied to an arbitrary type of a sewing machine. For example, the present disclosure may be applied to a multi-needle type embroidery sewing machine equipped with a plurality of needle bars. As a modified embodiment, a multi-needle type embroidery sewing machine 300 will be described below with reference to drawings. First, a physical configuration of the multi-needle type embroidery sewing machine 300 will be described below with reference to, for example, FIGS. 14-16. It is to be noted that in FIG. 14, the side of the paper toward the user may be referred to as a "front side" and, the side thereof away from the user may be referred to as a "rear side". Further, the right and left directions as viewed from the user may be referred to as right and left directions. Further, a mouse 340 is not shown in FIG. 15. Further, in FIGS. 15 and 16, for simplification of the figures, a sewing needle 319 (see FIG. 14), which is not shown, may be attached to each of needle bars 327 (see FIG. 16).

Figure 14:
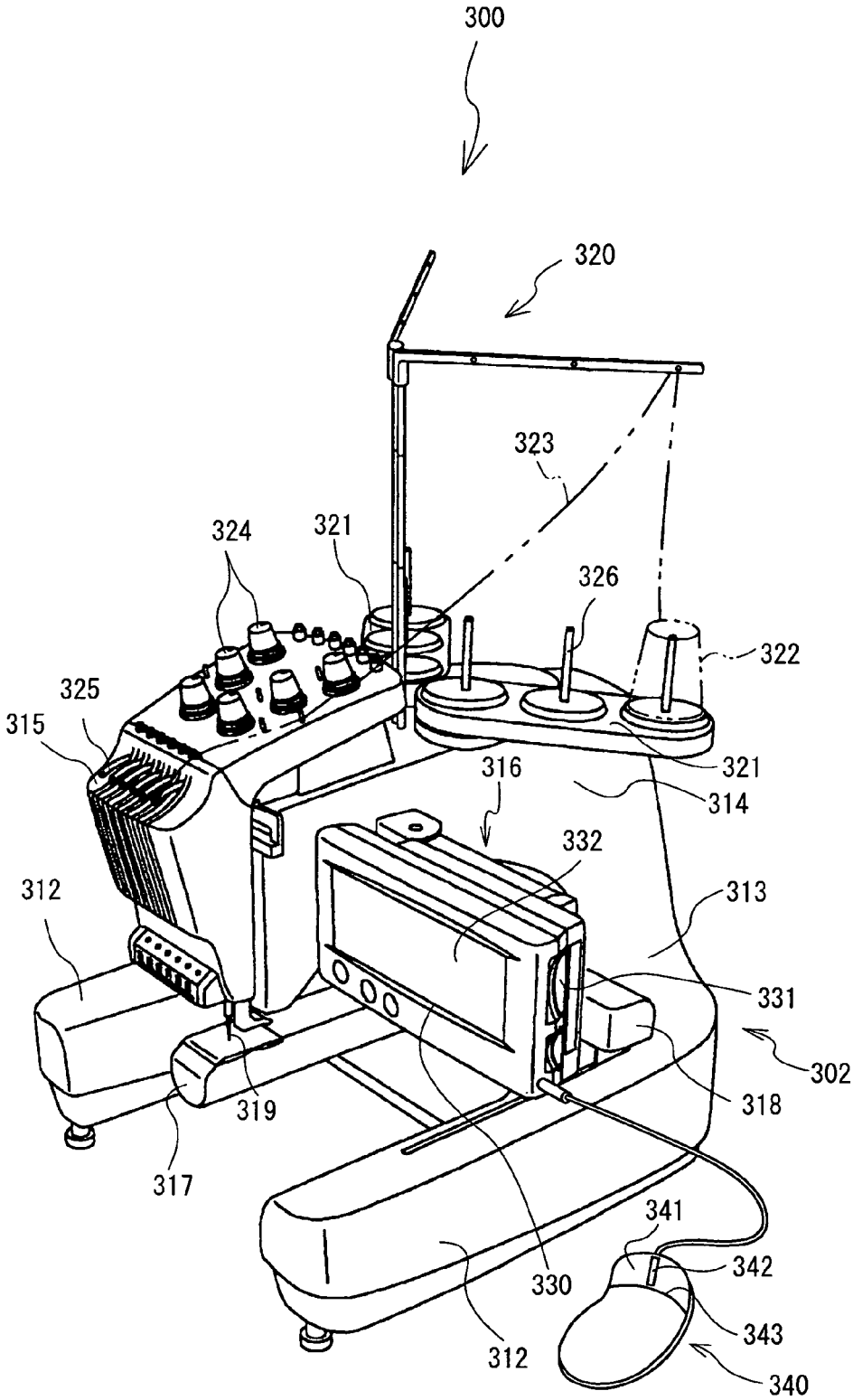
FIG. 14 is a perspective view of a multi-needle type embroidery sewing machine.
Figure 15:
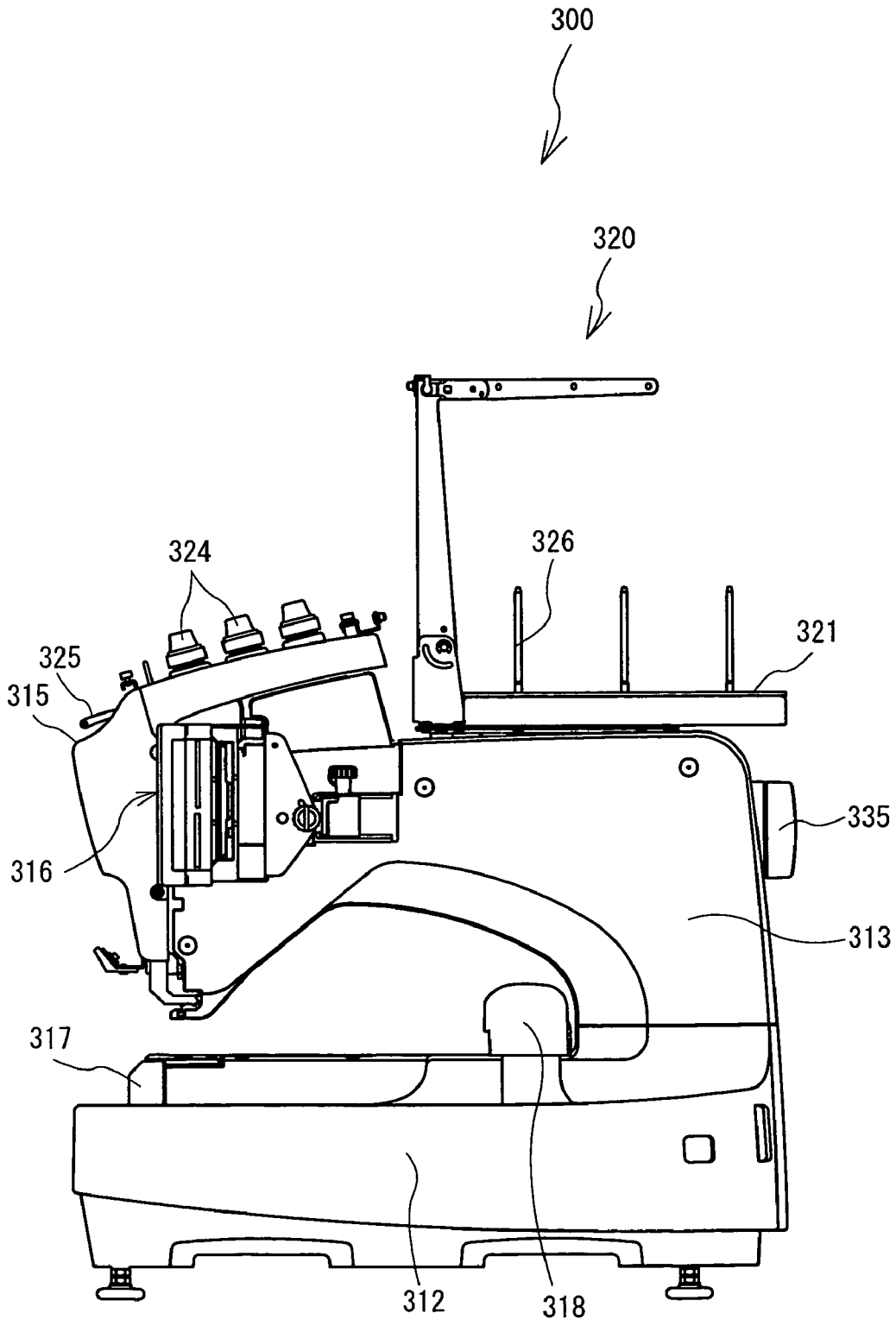
FIG. 15 is a right side view of the multi-needle type embroidery sewing machine.
Figure 16:
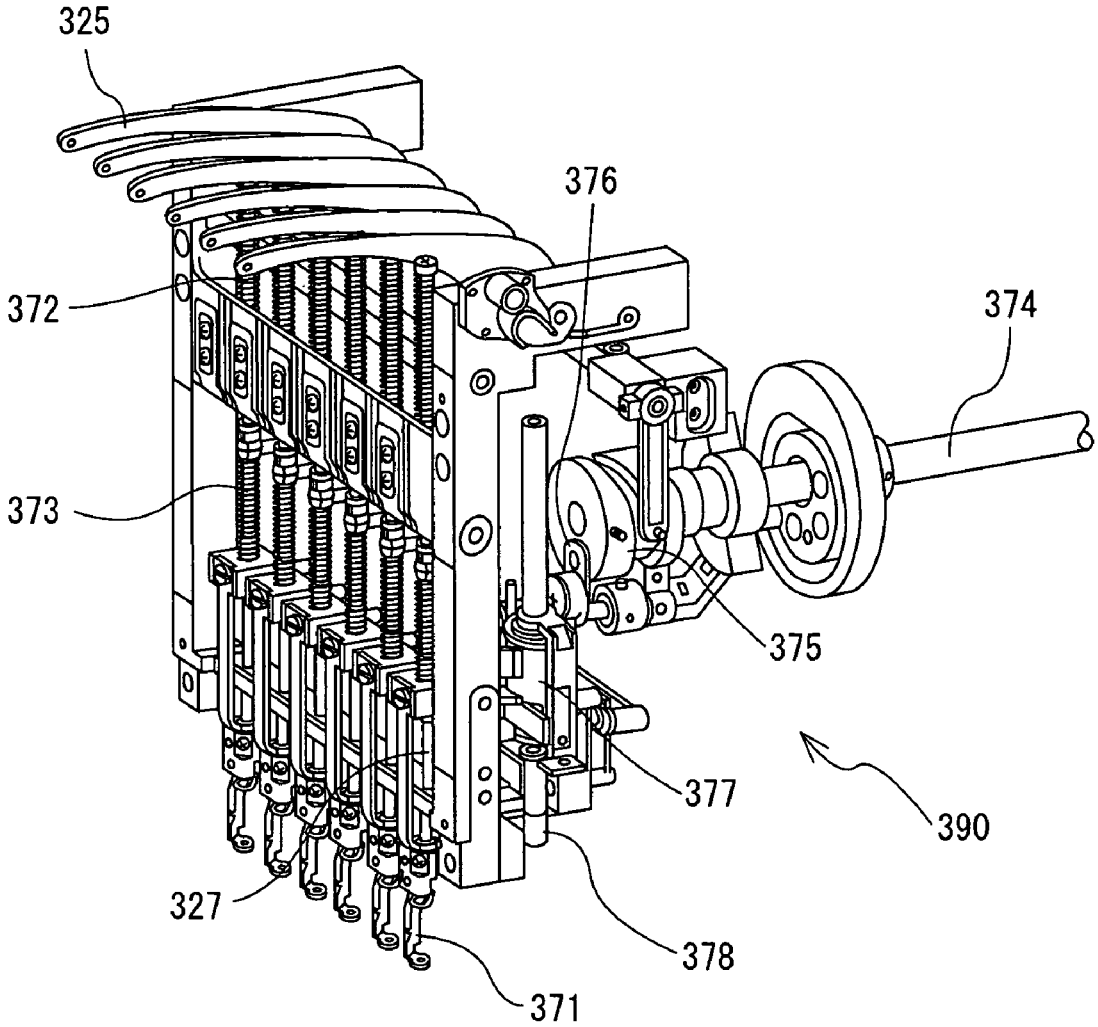
FIG. 16 is a perspective view of the internal configuration of the needle bar case of the multi-needle type embroidery sewing machine.

As shown in FIGS. 14-16, the multi-needle type embroidery sewing machine 300 may include a support section 312 that may support the multi-needle type embroidery sewing machine 300, a pillar 313 that may erect upward from the support section 312, and an arm portion 314 that may extend from the upper end part of the pillar 313 toward the front side. Further, at the end of the arm portion 314, a needle bar case 315 may be mounted in such a manner that it may move in the right and left direction. At the middle part on the right side surface of the arm portion 314, an operating section 316 may be axially supported on the arm portion 314. The operating section 316 may be switched in position between a housing position where it is folded back on itself in such a manner as to be parallel with the front and rear direction of the multi-needle type embroidery sewing machine 300 and an operating position shown in FIG. 14. Further, below the arm portion 314, a cylinder bed portion 317 may be provided that may extend from the lower end part of the pillar 313 toward the front side. Further, below the arm portion 314 and at the lower end part of the pillar 313, a rod-shaped embroidery frame movement mechanism 318 may be provided in such a manner as to extend in the right and left direction. The following will describe in detail the configuration of the sections of the multi-needle type embroider sewing machine 300.

First, a thread spool table 321 that may be mounted on the arm portion 314 at its upper rear part will be described below with reference to FIGS. 14 and 15. As shown in FIGS. 14 and 15, at the upper rear part of the arm portion 314, the right-and-left pair of the thread spool table 321 may be provided on which a plurality of thread spools 322 may be set. A thread guide mechanism 320 may be provided in such a manner as to correspond to the thread spool table 321. The thread spool table 321 and the thread guide mechanism 320 may be structured so that they may be switched in position between the housing position and a use position where they may be opened toward the rear side as viewed in ground plan as shown in FIG. 14. The thread spool tables 321 may each be equipped with three thread spool pins 326 to each of which a thread spool 322 is fit and so may be loaded with three thread spools 322, respectively. Therefore, the right-and-left pair of thread spool tables 321 may be loaded with the six thread spools 322, which may be the same as the number of the sewing needles 319. A needle thread 323 extending from each of the thread spools 322, which may be set on the thread spool table 321, may pass through the thread guide mechanism 320, a tensioner 324, a thread take-up lever 325, etc. and may be supplied to each of the sewing needles 319. The thread guide mechanism 320 may be used to prevent the needle thread 323 from being tangled and the tensioner 324 may be used to adjust the tension of the thread. The thread take-up lever 325 may reciprocate up and down to take up the needle thread 323.

Next, the internal configuration of the needle bar case 315 provided in front of the arm portion 314 will be described below with reference to FIG. 16. As shown in FIG. 16, the needle bar case 315 may incorporate six needle bars 327, each of which may have the sewing needle 319 (see FIG. 14) attached at the lower end part. The needle bar 327 may be supported vertically slidably by two upper and lower fixed members (not shown), which may be fixed on the frame of the needle bar case 315. Further, at the lower end part of the needle bar 327, a presser foot 371 may be provided which may slide vertically. At the upper half of the needle bar 327, a presser spring 372 may be provided, and at the lower half thereof, a presser spring 373 may be provided, respectively.

Next, the operating section 316 axially supported on the arm portion 314 will be described below with reference to, for example, FIG. 14. The operating section 316 may be equipped with an LCD 330, a flexible disk drive 331 (hereinafter abbreviated as "FDD") into which a flexible disk (not shown) is inserted, etc. The LCD 330 may display the thread information of a thread set to the needle bar 327 (see FIGS. 16 and 17), the embroidery data of an embroidery pattern, the needle bar number and the thread information, which correspond to the needle bar 327 subject to thread replacement, and function names, which may perform various functions used in embroidery, a variety of messages, etc. In front of the LCD 330, a touch panel 332 may be mounted. Various instructions may be inputted by selecting an item that may be displayed on the LCD 330 by using the finger or a dedicated touch pen or a mouse 340 that may be connected to the side surface of the operating section 316. The mouse 340 may be provided separately from a sewing machine body 302 and may be equipped with a wheel 342, a left button 341, a right button 343, and a movement detection section 344 (see FIG. 17) as its operation members. The mouse 340 may be operated to enter a command, which may control the operations of the multi-needle type embroidery sewing machine 300. The commands may be assigned to the mouse 340 by, for example, the same method as that for the mouse entry processing of the first embodiment. Then, if an output signal that may correspond to the operation state of any one of the operation members of the mouse 340 is inputted to a later-described control unit 339, a CPU 345 shown in FIG. 17 may execute an assigned command that may correspond to the output signal.

Next, operations of forming stitches on a work cloth held by an embroidery frame (not shown) supported by the embroidery frame movement mechanism 318 (see FIG. 2) will be described below with reference to, for example, FIGS. 14-16. First, the needle bar case 315 may move in the right and left direction, to select one of the six needle bars 327. Then, the drive shaft 374 may be rotated by the sewing machine motor 354 (see FIG. 17). The rotary driving force may be transmitted via a thread take-up lever drive cam 375 to a coupling member 376, to vertical drive a transmission member 377 on which the coupling member 376 may be pivoted as this transmission member 377 may be guided by a guide rod 378 which may be disposed in parallel with the needle bar 327. The vertically driving force may be transmitted via a coupling pin (not shown) to the needle bar 327, which may in turn be driven up and down together with the sewing needle 319. In the multi-needle type embroidery sewing machine 300 of the modified embodiment, a needle bar up-and-down movement mechanism 390 may include the thread take-up lever drive cam 375, the coupling member 376, the transmission member 377, and the guide rod 378. When such needle bar 327 is driven up and down by the operations of the needle bar up-and-down movement mechanism 390, which uses the sewing machine motor 354 as a source of power, stitches may be formed on the work cloth.

Figure 17:
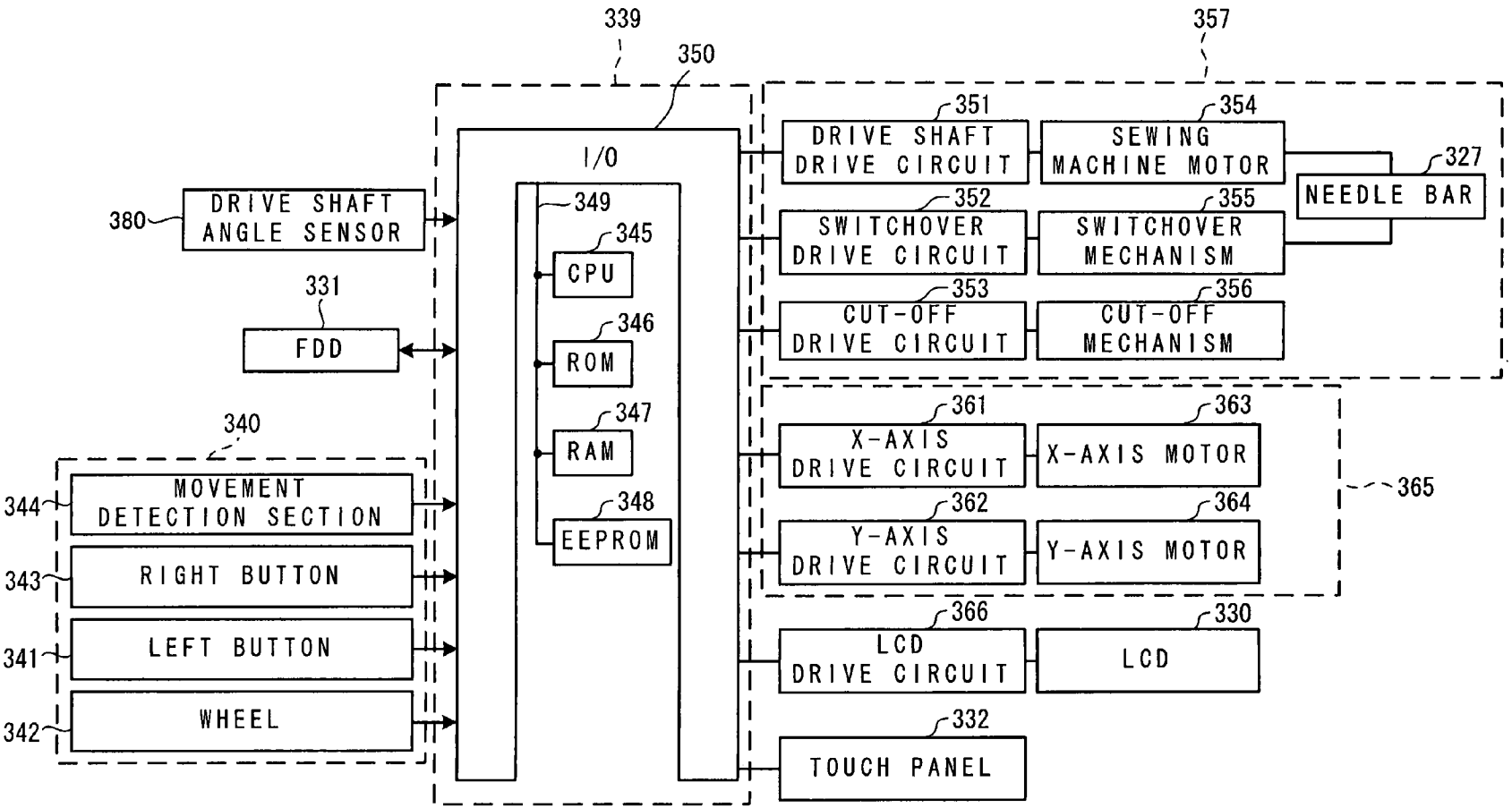
FIG. 17 is a block diagram of the electrical configuration of the multi-needle type embroidery sewing machine.

Next, an electrical configuration that conducts overall control on the multi-needle type embroidery sewing machine 300 will be described below with reference to, for example, FIG. 17. As shown in FIG. 17, the multi-needle type embroidery sewing machine 300 may include a sewing needle drive section 357, an embroidery target drive section 365, and a control unit 339. Also, similar to the first embodiment, a drive shaft angle sensor 380 may also be provided which optically detects the revolution of the drive shaft 374. The following will describe in detail each of the sewing needle drive section 357, the embroidery target drive section 365, and the control unit 339 that may configure the multi-needle type embroidery sewing machine 300.

The sewing needle drive section 357 may be equipped with the needle bar 327, the sewing machine motor 354, a drive shaft drive circuit 351, a switchover mechanism 355, a switchover drive circuit 352, a cut-off mechanism 356, and a cut-off drive circuit 353. A sewing machine motor 354 may be used to reciprocate the needle bar 327 up and down. The drive shaft drive circuit 351 may be used to drive the sewing machine motor 354 in accordance with a control signal from the control unit 339. The switchover mechanism 355 may be used to change the needle bars 327 for sewing and the switchover drive circuit 352 may be used to drive the switchover mechanism 355 in accordance with the control signal from the control unit 339. The cut-off mechanism 356 may be used to cut off a thread which is set to the sewing needle 319 (see FIG. 14) and the cut-off drive circuit 353 may be used to drive the cut-off mechanism 356 in accordance with the control signal from the control unit 339.

The embroidery target drive section 365 may be equipped with an X-axis motor 363, an X-axis drive circuit 361, a Y-axis motor 364, and a Y-axis drive circuit 362. The X-axis motor 363 may be used to move the embroidery frame (not shown) in the right and left direction and the X-axis drive circuit 361 may be used to drive the X-axis motor 363 in accordance with the control signal from the control unit 339. The Y-axis motor 364 may be used to move the embroidery frame (not shown) in the front and rear direction and the Y-axis drive circuit 362 may be used to drive the Y-axis motor 364 in accordance with the control signal from the control unit 339.

The control unit 339 may include a CPU 345 which may conduct main control over the multi-needle type embroidery sewing machine 300, a ROM 346, a RAM 347, and an EEPROM 348, an input/output interface (I/O) 350, which may be connected to each other through a bus 349. To the input/output interface 350, the sewing needle drive section 357 and the embroidery target drive section 365 as well as the drive shaft angle sensor 380, the FDD 331, the mouse 340, the touch panel 332, and the LCD drive circuit 366 which may control the LCD 330, may respectively be connected. The mouse 340 may be equipped with the left button 341, the wheel 342, the right button 343, and a movement detection section 344 as its operation members so that each of the operation members may provide an output signal to the input/output interface 350. In the modified embodiment, to perform the mouse entry processing such as that in the first embodiment, a program of the mouse entry processing may be stored in the ROM 346 beforehand and performed by the CPU 345 shown in FIG. 17. Further, a variety of kinds of information used to perform the mouse entry processing may be read appropriately from the ROM 346, the EEPROM 348 or the FD and may be stored in a predetermined storage area of the RAM 347.

As a result of applying the above-described first embodiment to the multi-needle type embroidery sewing machine 300 in accordance with the above-described modified embodiment, operation effects similar to those by the sewing machine 1 of the first embodiment may be obtained. Moreover, if "NEEDLE POSITION" is assigned to an output signal that may correspond to the operation state of the operation member of the mouse 340, the following effects may be obtained. As shown in FIG. 15, the pulley 335 may be mounted on the rear surface of the multi-needle type embroidery sewing machine 300 and so should not easily be accessed by the user. In contrast, in the multi-needle type embroidery sewing machine 300 of the modified embodiment, the sewing needle 319 (the needle bar 327) may be moved vertically to a desired position by rolling the wheel 342 forward or backward, which may be assigned the "NEEDLE POSITION" command in the mouse entry processing. It may thus be possible to move the sewing needle 319 through simple operations not depending on the set position of the pulley 335, and thereby the efficiency of the sewing work may be improved.

Figure 18:
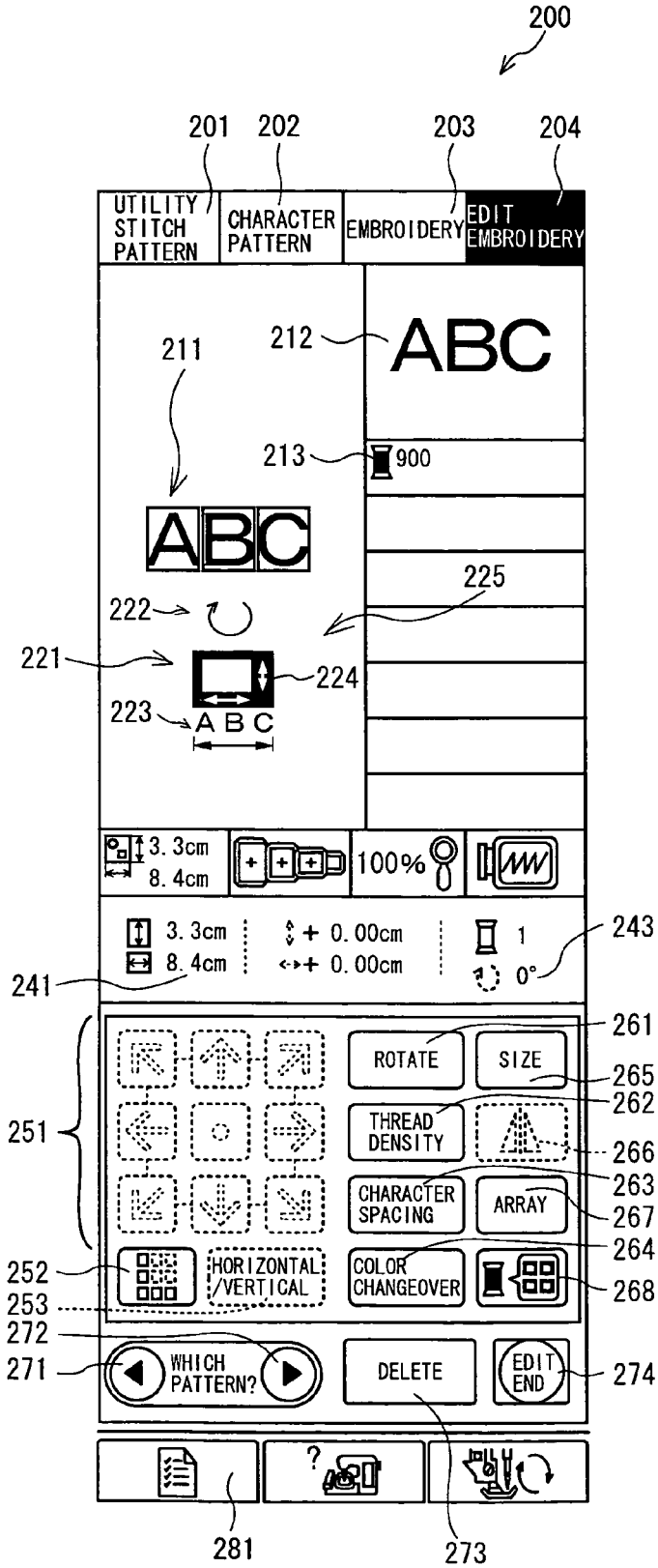
FIG. 18 is an explanatory illustration of a screen which is displayed on the LCD.

Although the first embodiment may assign a sewing-related command to an output signal that may correspond to the operation state of each of the operation members of the mouse 27 in the mouse entry processing, such a command may be assigned as to edit an embroidery pattern to be sewed as an embroidery by a sewing machine as in the case of a second embodiment to be described below. The following will describe the second embodiment having similar physical and electrical configurations as those of the sewing machine 1 of the first embodiment with reference to FIG. 18-25. Processing to edit an embroidery pattern through the operation of the mouse 27 will be described below using an Example 2 in the second embodiment. The Example 2 is the case of editing an embroidery pattern 211 composed of upper-case alphabetic characters "ABC" as shown in FIG. 18. It is to be noted that a program to perform each of processing pieces shown in FIG. 20 may be stored beforehand in the ROM 62 and so may be read into a program storage area 631 of the RAM 63 when the program is performed and executed by, for example, the CPU 61, as shown in FIG. 3.

First, a screen 200, which may appear on an LCD 15, will be described below with reference to FIG. 18. As shown in FIG. 18, the screen 200 may be used to edit an embroidery pattern. At the upper part of the screen 200 a utility stitch pattern key 201, a character pattern key 202, an embroidery key 203, and an edit embroidery key 204, respectively, may be displayed. The utility stitch pattern key 201 may be pressed to select a utility stitch pattern and the character pattern key 202 may be pressed to select a pattern such as a character or a decoration. The embroidery key 203 may be pressed to embroider something and the edit embroidery key 204 may be pressed to sew a combination of embroidery patterns. The screen 200 may display a state where the edit embroidery key 204 may be selected.

Also, at the upper left part of the screen 200, the embroidery pattern 211 composed of the upper-case alphabetic characters "ABC" may be displayed as a target for editing. Further, at the upper left part of the screen 200, a command candidate display field 225 may be provided, in which the candidate of a command to be assigned to a wheel 28 of the mouse 27 may be displayed by a command illustration. A command candidate may be displayed in a state where processing to select a command to be assigned to the wheel 28 may be in process (hereinafter referred to as a "command switchover state"). In an ordinary state other than the command switchover state, usually, only a command assigned to the wheel 28 should be displayed in the command candidate display field 225. On the screen 200, three commands of ROTATE 222, SIZE 221, and CHARACTER SPACING 223 may be displayed as the candidates of the commands to be assigned to the wheel operation. The ROTATE 222 command, which may be displayed above the command candidate display field 225, may be used to rotate the embroidery pattern 211. The SIZE 221 command, which may be displayed at the midsection of the command candidate display field 225, may be used to adjust the size of an embroidery pattern. The CHARACTER SPACING 223 command, which may be displayed below the command candidate display field 225, may be used to adjust a character spacing of the embroidery pattern 211. Currently, the SIZE 221 command may be tentatively selected, as it may be black-and-white reverse displayed by a cursor 224 at the midsection of the command candidate display field 225. In the second embodiment, the commands that may be assigned to the wheel 28 may be put in a database like a table 700 of FIG. 19. Then, three out of the commands in the table 700 may be read in the descending order of execution frequency and may be displayed on the screen 200. The table 700 will be described in detail later.

At the upper right part of the screen 200, an embroidery pattern display field 212 and a thread information display field 213 may be provided. The embroidery pattern display field 212 may display the embroidery pattern 211 to be edited and the thread information display field 213 may display the thread information of a thread to be used when embroidering the embroidery pattern 211. Further, at the midsection of the screen 200 in its longer direction, a size display field 241 and a rotation angle display field 243 may be provided, respectively. The size display field 241 may display the size of the embroidery pattern 211 and the rotation angle display field 243 may display the rotation angle of the embroidery pattern 211. In addition, at the lower part of the screen 200, edit buttons may be displayed for entering a command to edit the embroidery pattern 211. For example, the edit buttons displayed may include a rotation key 261, a size key 265, a thread density key 262, a right-and-left reverse key 266, a character spacing key 263, an array key 267, a color changeover key 264, a thread pallet key 268, arrow keys 251, a border key 252, and a horizontal/vertical writing key 253. The rotation key 261 may be used to rotate a pattern. The size key 265 may be used to set the size of a pattern. The thread density key 262 may be used to set a thread density which may be employed when sewing a pattern. The right-and-left reverse key 266 may be used to reverse the right and the left of a pattern. The character spacing key 263 may be used to set the spacing between character patterns. The array key 267 may be used to set the array of a character pattern. The color changeover key 264 may be used to set each character of a color thread when sewing a character pattern. The thread pallet key 268 may be used to set the color of a pattern currently displayed. The arrow keys 251 may be used to move a position where a pattern is sewed. The border key 252 may be used to give a pattern continually. The horizontal/vertical writing key 253 may be used to switch between horizontal writing and vertical writing. As described above, because the embroidery pattern 211 may be a character pattern as described in Example 2, it may be impossible to select the arrow keys 251, the horizontal/vertical writing key 253, and the right-and-left reverse key 266, whose button profiles may be indicated by a broken line, out of the above-described edit buttons. Below the edit buttons, pattern selection keys 271 and 272, a deletion key 273, and an edit end key 274, respectively, may be displayed. The pattern selection keys 271 and 272 may be used to select a pattern. The deletion key 273 may be used to delete a pattern selected. The edit end key 274 may be used to end editing and bring the process forward to the next step. At the lower left part of the screen 200, a setting key 281 may be displayed, which changes the standard settings of the sewing machine 1.

Next, the table 700 will be described below with reference to, for example, FIG. 19. Data in the table 700 may be stored in the EEPROM 64 shown in FIG. 3 and updated as necessary and, before the performance of mouse entry processing, may be read into a predetermined storage area of the RAM 63. In the table 700, the commands that may be assigned to the wheel 28 may be registered. For example, in the table 700, a command execution frequency 701, a command 702, and an illustration 703 that corresponds to the command 702, respectively, may be registered. The command execution frequency 701 may be obtained by (an execution count of a command)/(an execution count of all of the commands registered in the table 700)×100(%). In the command candidate display field 225 of the screen 200 shown in FIG. 18, SIZE 221, ROTATE 222, and CHARACTER SPACING 223, which may have been read in a descending order of the command execution frequency 701, may be displayed, out of which SIZE 221 may be tentatively selected by the cursor 224.

Next, the mouse entry processing of the second embodiment will be described with reference to, for example, FIG. 20. In the second embodiment, two states of a command switchover state and a state, which may not be the command switchover state, may be switched from each other in accordance with the right button output signal and the left button output signal. In the command switchover state, to a wheel output signal, such processing may correspond as to switch the candidate of a command to be assigned to the wheel output signal. In the state that may not be the command switchover state, a command assigned to a wheel output signal may correspond to the wheel output signal, in response to which signal the embroidery pattern 211 may be edited.

Figure 20:
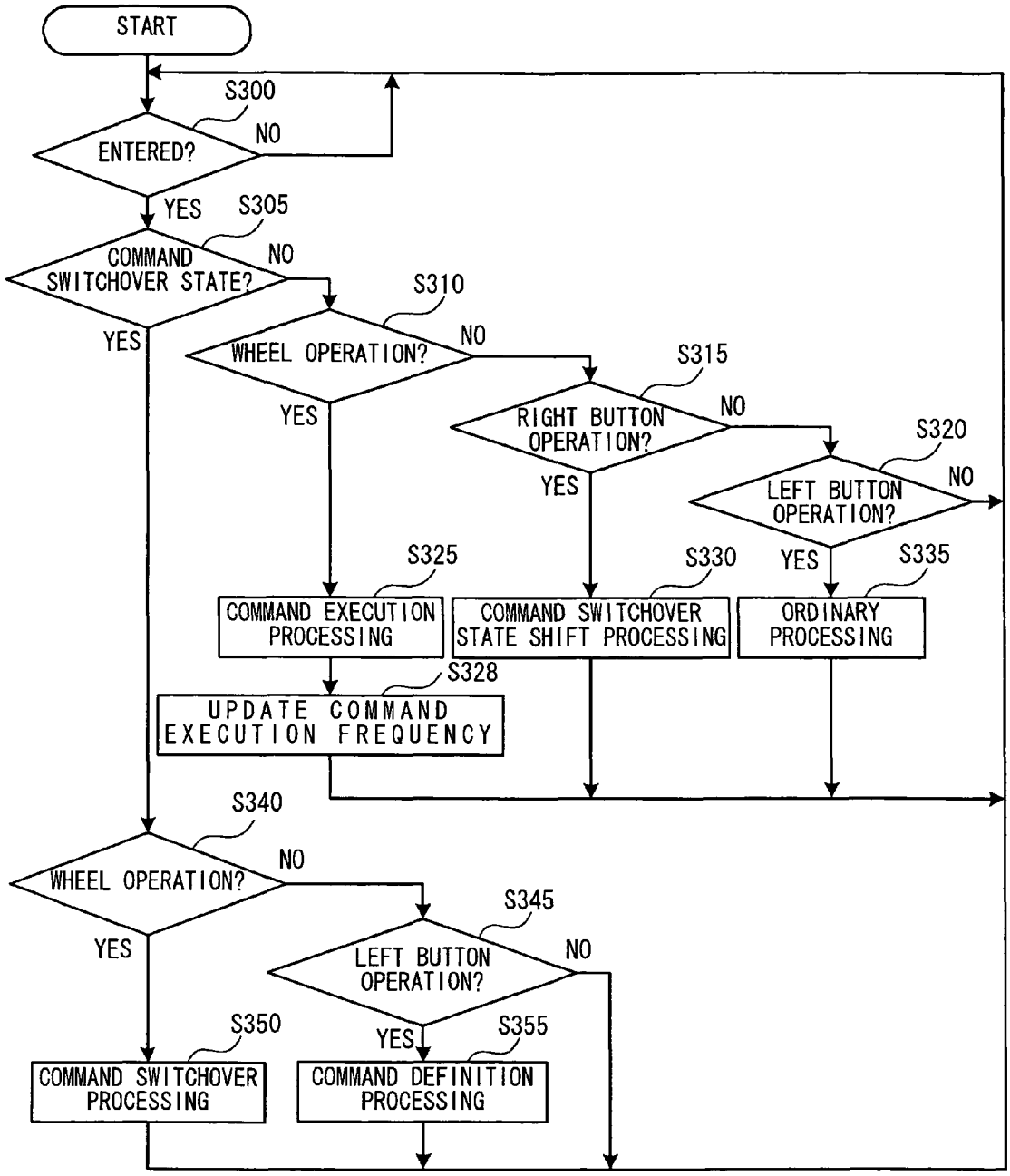
FIG. 20 is a flowchart of the mouse entry processing.

As shown in FIG. 20, in the mouse entry processing of the second embodiment, the CPU 61 may first determine whether an output signal provided from any one of the right button 36, the left button 37, and the wheel 28 of the mouse 27 may be inputted to the control section 60 (S300). In the second embodiment, processing to address the output signal from an movement detection section 35 of the mouse 27 may be performed in any processing other than the mouse entry processing shown in FIG. 20. If the output signal provided from any one of the right button 36, the left button 37, and the wheel 28 is not inputted to the control section 60 (NO at S300), the CPU 61 may wait until it determines that the output signal is inputted. On the other hand, if the output signal provided from any one of the right button 36, the left button 37, and the wheel 28 is inputted to the control section 60 (YES at S300), the CPU 61 may store the output signal thus may input, in the output signal storage area 633.

Subsequently, the CPU 61 may reference the flag storage area 635 to determine whether the system is in the command switchover state (S305). Whether the system is in the command switchover state may be determined on the basis of a command switchover flag, which may be stored in the flag storage area 635. For example, if the command switchover flag is ON, the CPU 61 may determine that the system is in the command switchover state and, if the command switchover flag is OFF, may determine that the system is not in the command switchover state. The command switchover flag is OFF initially and set ON in the later-described processing of S330 and set OFF at S355. The processing to be performed when the system is not in the command switchover state (NO at S305) will be described later. On the other hand, if the system is in the command switchover state (YES at S305), the CPU 61 may reference the output signal storage area 633 to determine whether the output signal provided by the mouse 27 and detected at S300 is a wheel output signal (S340).

Figure 23:
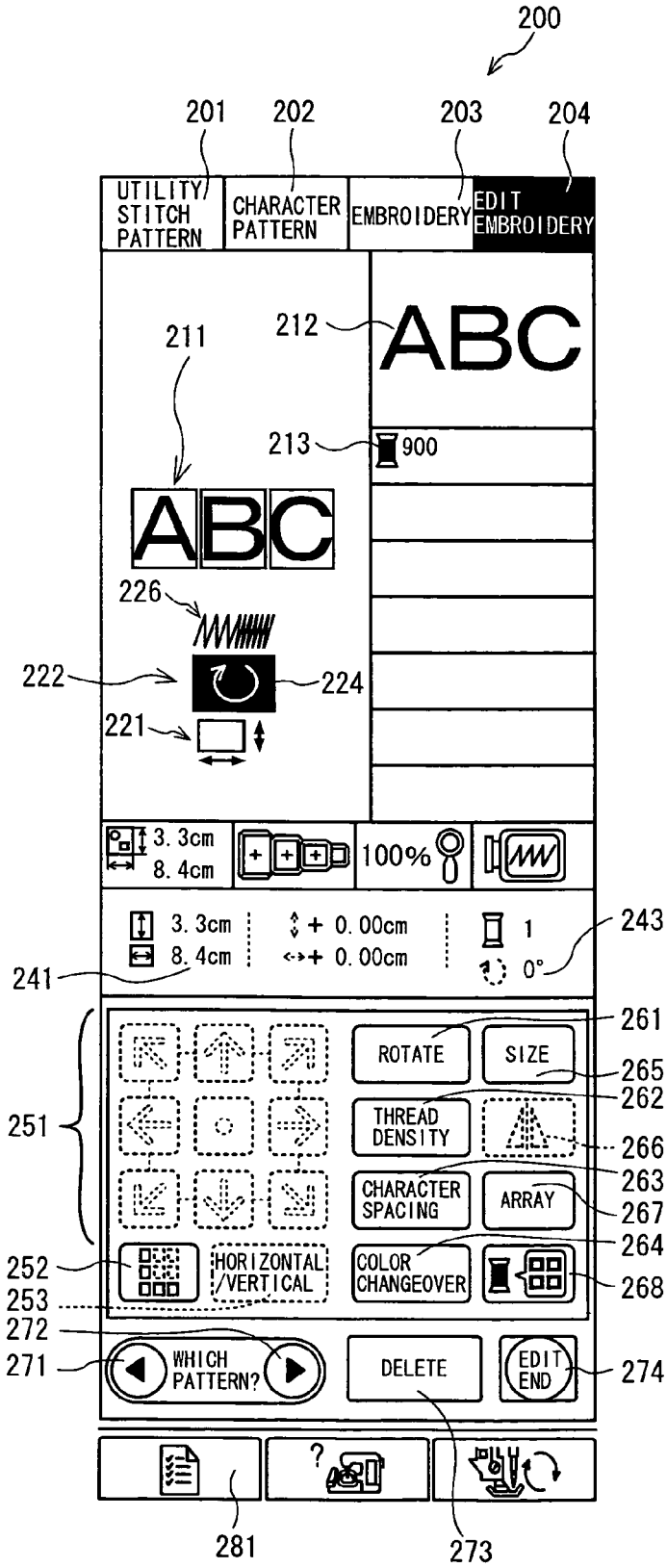
FIG. 23 is an explanatory illustration of the screen in a case where "ROLL" is tentatively selected as a command which is assigned to the wheel.

If the output signal provided by the mouse 27 and detected at S300 is a wheel output signal (YES at S340), the CPU 61 may perform the command switchover processing (S350). In the command switchover processing, the CPU 61 may perform processing to switch a command to be displayed in the command candidate display field 225 of the screen 200 in accordance with a wheel operation. In the second embodiment, the relationship between the output signal and a command to switch the command to be displayed may be defined as follows. Each time the wheel 28 is rolled backward by 15 degrees, commands to be displayed in the command candidate display field 225 may be slid one by one upward so that the immediately following command in execution frequency may be displayed newly. Similarly, each time the wheel 28 is rolled forward by 15 degrees, commands to be displayed in the command candidate display field 225 may be slid one by one downward, as shown in FIG. 23, so that the immediately previous command in execution frequency may be displayed newly. By thus defining the relationship between the output signal that may correspond to the wheel operation and the command, which switches display in the command candidate display field 225, the user may easily select a desired command by using the mouse 27. Subsequent to S350, the CPU 61 may return to S300 to repeat the processing.

Figure 21:
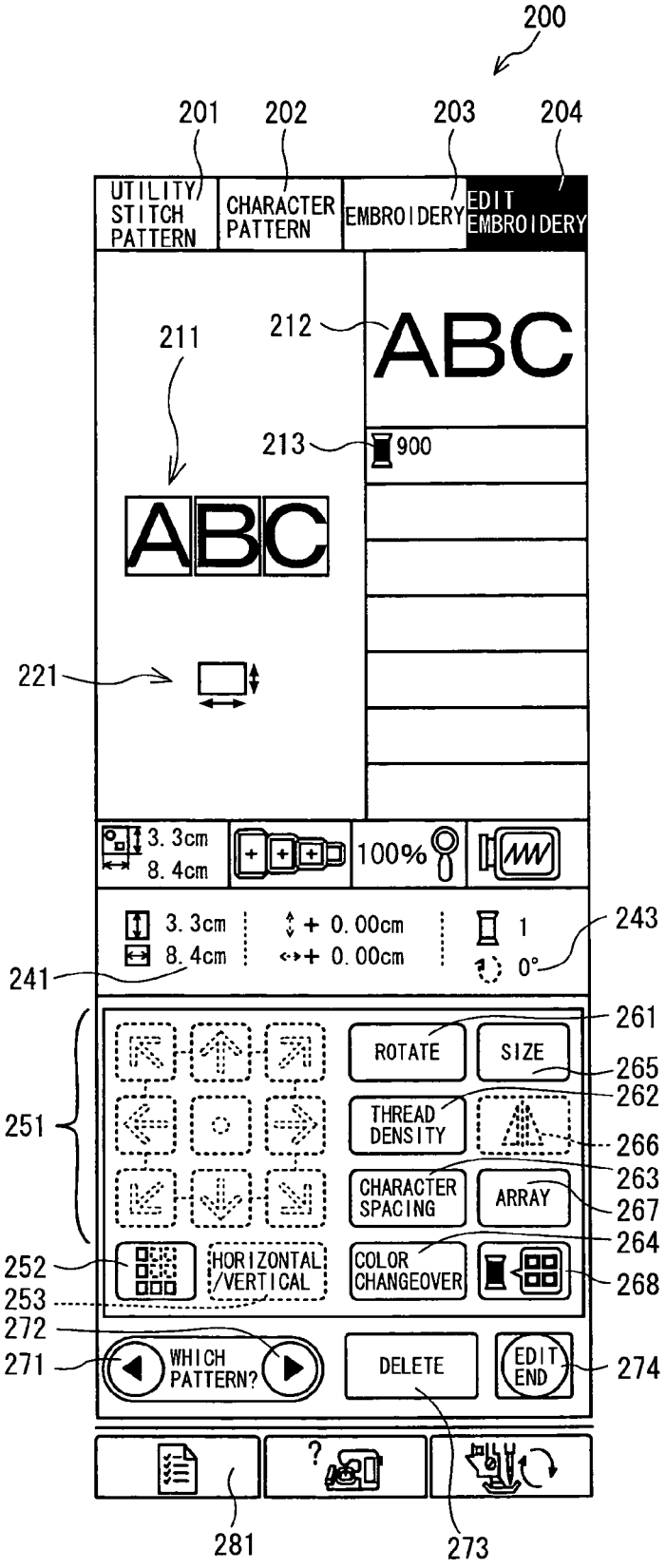
FIG. 21 is an explanatory illustration of the screen in a case where "SIZE" is assigned to a wheel operation.
Figure 24:
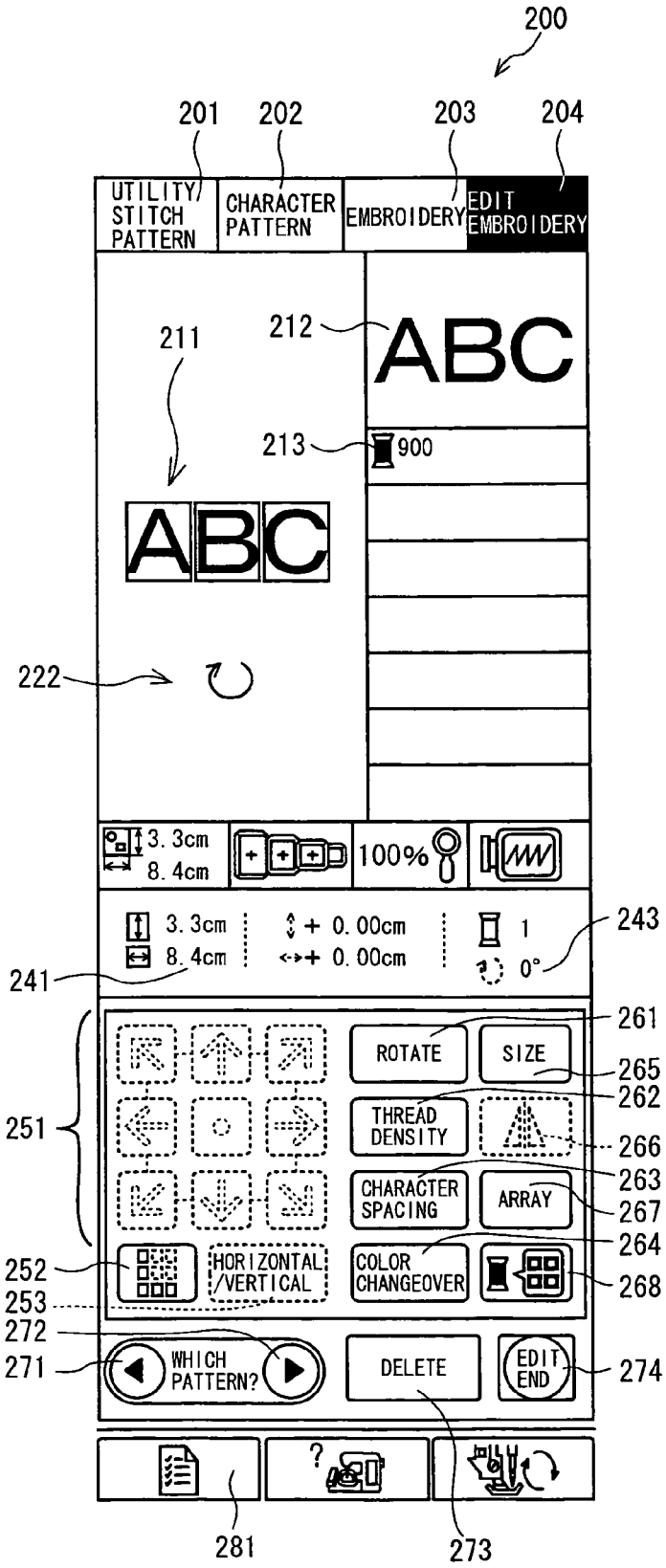
FIG. 24 is an explanatory illustration of the screen in a case where "ROLL" is assigned to the wheel.

On the other hand, if the output signal provided by the mouse 27 and detected at S300 is not a wheel output signal (NO at S340), the CPU 61 may determine whether the output signal detected at S300 is a left-button output signal (S345). In the second embodiment, unlike the mouse entry processing of the first embodiment, the CPU 61 should not perform the different processing even if the left-button operation is double clicking. If it is determined that the output signal is a left-button output signal (YES at S345), the CPU 61 may perform command definition processing (S355). In the command definition processing, the CPU 61 may assign to the wheel operation one out of the commands displayed in the command candidate display field 225 of the screen 200 that may tentatively be selected as is black-and-white reverse displayed by the cursor 224 and may store it in the set command storage area 634 (S355). Further, the CPU 61 may set OFF the command switchover flag and may store it in the flag storage area 635 (S355). Moreover, the CPU 61 may display on the screen 200 only an illustration that may correspond to the command assigned to the wheel operation (S355). The screen 200 of FIG. 21 shows an example in which a state where the "SIZE" command is assigned to the wheel operation in the definition processing of S355. Similarly, the screen 200 of FIG. 24 shows a state where the "ROTATE" command is assigned to the wheel operation in the command definition processing of S355. Subsequent to S355, the CPU 61 may return to S300 to repeat the processing.

If it is determined at S345 that the output signal is not a left-button output signal (NO at S345), the CPU 61 may return to S300 to repeat the processing. In such a manner, in the command switchover state of the second embodiment, the CPU 61 may not perform processing that corresponds to the right-button output signal, which processing may be replaced by any other processing assigned.

If it is determined at S305 that the system is not in the command switchover state (NO at S305), the CPU 61 may reference the output signal storage area 633 to determine whether the output signal detected at S300 is a wheel output signal (S310). If the output signal is a wheel output signal (YES at S310), the CPU 61 may perform command execution processing (S325). In the command execution processing, a command assigned to the wheel output signal may be executed. In this processing, a command defined in the command definition processing of S355 may be executed.

Figure 22:
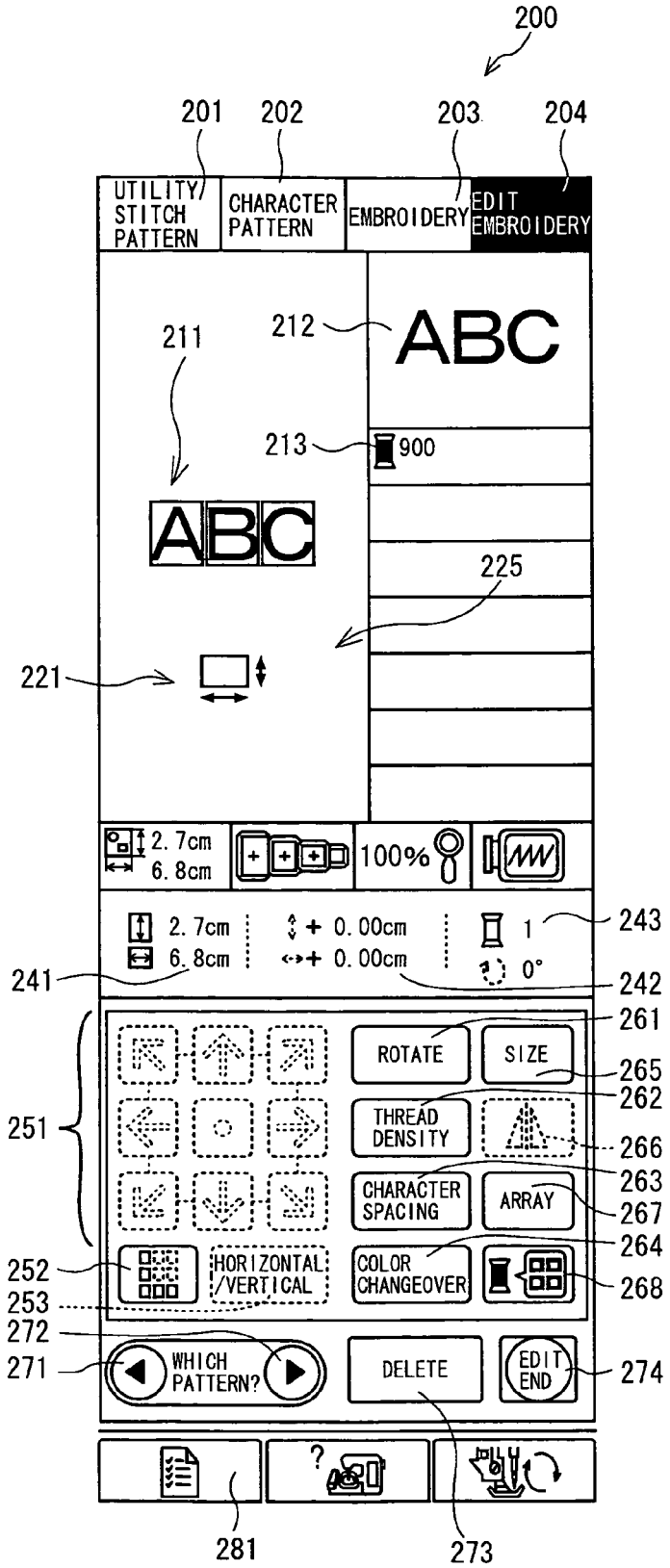
FIG. 22 is an explanatory illustration of the screen in a case where an embroidery pattern is scaled down by the operation of the wheel.

For example, as shown in FIG. 21, if "SIZE" is assigned to a wheel operation at S355, the CPU 61 may perform processing to scale up or down the size of the embroidery pattern 211 in accordance with a wheel output signal. Whether to scale up or down the size and how much to do so may be determined on the basis of output signals that correspond to the rolling direction and the rolling amount (angle) of the wheel 28, respectively. Correspondence between whether to scale up or down the size and how much to do so and the output signals may be predfined and stored in the ROM 62. In the second embodiment, such correspondence may be defined that each time the wheel 28 is rolled backward by 15 degrees, the embroidery pattern 211 may be scaled up by 1.1-fold, and each time the wheel 28 is rolled forward by 15 degrees, the embroidery pattern 211 may be scaled down by 0.9-fold. If a wheel operation may be performed to roll the wheel 28 forward by 30 degrees, at S325 the CPU 61 may scale down the embroidery pattern 211 by 0.81-fold and may display it on the screen 200 as shown in FIG. 22. Also, the CPU 61 may modify the embroidery data of the embroidery pattern 211 and may store it in a predetermined storage area of the RAM 63.

Figure 25:
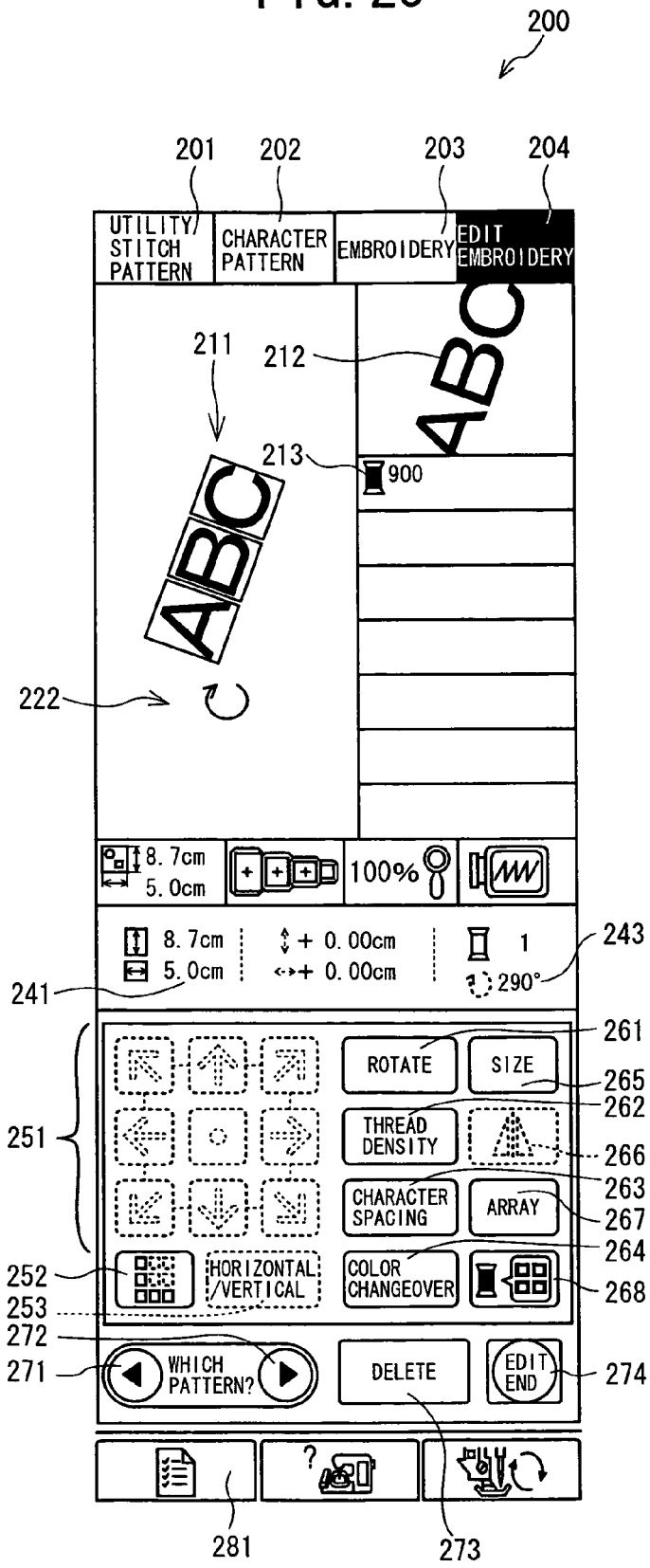
FIG. 25 is an explanatory illustration of the screen in a case where the embroidery pattern is rotated by the operation of the wheel.

Further, as shown in FIG. 24, for example, if "ROTATE" is assigned to a wheel operation at S355, the CPU 61 may perform processing to rotate the embroidery pattern 211 in accordance with a wheel output signal. Whether to rotate it clockwise or counterclockwise and how much to do so may be determined on the basis of output signals that may correspond to the rolling direction and the rolling amount of the wheel 28, respectively. Correspondence between the rotation angle and the rotation direction of the embroidery pattern 211 and the output signals may be predefined and stored in the ROM 62. In the second embodiment, such correspondence may be defined that each time the wheel 28 is rolled backward by 15 degrees, the embroidery pattern 211 may be rotated clockwise by 10 degrees and each time the wheel 28 is rolled forward by 15 degrees, the embroidery pattern 211 may be rotated counterclockwise by 10 degrees. If a wheel operation is performed to roll the wheel 28 forward by 105 degrees, at S325 the CPU 61 may rotate the embroidery pattern 211 by 70 degrees counterclockwise and may display it on the screen 200 as shown in FIG. 25. Also, the CPU 61 may modify the embroidery data of the embroidery pattern 211 and may store it in a predetermined storage area of the RAM 63.

Subsequent to S325, the CPU 61 may update the command execution frequency 701 shown in the table 700 (S328). This processing may be performed to update the execution frequency of a command that may be assigned to a wheel operation and registered in the table 700 each time the user executes the command. For example, the CPU 61 may increment by 1 both the execution count of a command executed at S325 out of those command-specific execution counts in the table 700 that may be stored in a predetermined storage area of the RAM 63 and the execution count of all of the commands that may be registered in the table 700. Subsequently, the CPU 61 may calculate the execution frequency, that is, (execution count of the command)/(execution count of all of the commands registered in the table 700)×100, of each of the commands and may store it in a predetermined storage area of the RAM 63. Subsequent to S328, the CPU 61 may return to S300 to repeat the processing. It is to be noted that the processing of S328 may be omitted if a command displayed in the command candidate display field 225 is not read owing to its execution frequency.

Subsequent to S310, if it is determined that the output signal detected at S300 is not a wheel output signal (NO at S310), the CPU 61 may determine whether the output signal is a right-button output signal (S315). If the output signal is a right-button output signal (YES at S315), the CPU 61 may perform command switchover state shift processing (S330). In the command switchover state shift processing, a command to be assigned to the wheel 28 may be switched. In the command switchover state shift processing, for example, the CPU 61 may set ON the command switchover flag and may store it in the flag storage area 635 (S330). Subsequently, the CPU 61 may return to S300 to repeat the processing.

On the other hand, if the output signal is not a right-button output signal (NO at S315), the CPU 61 may reference the output signal storage area 633 to determine whether the output signal that may be provided by the mouse 27 and detected at S300 is a left-button output signal (S320). If the output signal is a left-button output signal (YES at S320), the CPU 61 may perform ordinary processing (S335). In the ordinary processing, for example, an item displayed on the LCD 15 may be selected. On the other hand, if it is determined at S320 that the output signal is not a left-button output signal (NO at S320), the CPU 61 may return to S300 to repeat the processing.

As described in detail above, in the sewing machine 1 of the second embodiment, a command required to edit the embroidery pattern 211 displayed on the LCD 15 may be assigned to the wheel operation, to enable editing the embroidery pattern 211 through the operations of the wheel 28.

By the mouse entry processing of the second embodiment, an instruction that may be used when editing the embroidery pattern 211 may be easily entered through the mouse 27 equipped with the wheel 28. Further, the candidates of commands that may be assigned to a wheel output signal may be read in the descending order of the execution frequency of the commands, so that the user may quickly select the command to be assigned to the wheel operation. It is thus possible to efficiently select a desired one from among the commands in the command candidate display field 225.

It is to be noted that the above-detailed second embodiment may be modified variously. For example, although the second embodiment may read the commands that may be displayed in the command candidate display field 225 in the descending order of execution frequency and displayed them, the present disclosure is not limited to it. They may be read in predetermined order. Further, the method for calculating the execution frequency of each of the commands is not limited to that of the second embodiment. For example, the execution frequency may be obtained on the basis of the execution situation of the command in a predetermined period or may be defined as a frequency at which the command is assigned to the operation member. Further, in place of the commands in the command candidate display field 225, the list of the command candidates may be displayed in response to a predetermined mouse operation.

Further, although the second embodiment may select such a command out of those displayed in the command candidate display field 225 as to be assigned to a predetermined output signal, the present disclosure is not limited to it. For example, the command may be assigned to each of the operation members automatically in accordance with its execution frequency. For example, in the above Example 2, the "ROTATE" command, which may be the highest in execution frequency in the table 700 shown in FIG. 19, may be assigned by single clicking of the left button 37, and the "SIZE" command, which is the second highest in execution frequency in that table 700, may be assigned by single clicking of the right button 36. In such a case, it is possible to automatically assign a command with a high execution frequency to the output signal from the mouse 27, and thereby the operation of assigning the commands may be omitted. Further, even if the number or the disposition of the operation members of some operation device is changed, it is possible to automatically assign the commands to the output signal from the operation signal efficiently.

In the above-described first and second embodiments, the commands may be assigned to the output signals that may correspond to the operation states of the operation members of the mouse 27. As the operation state of the operation member, the movement trajectory and movement order (which movement trajectory and movement order is hereinafter referred to as "gesture pattern") of the mouse 27 being dragged may be obtained on the basis of the output signal from the mouse 27, to execute the command that may correspond to the gesture pattern as in the case of a third embodiment to be described below.

Figure 27:
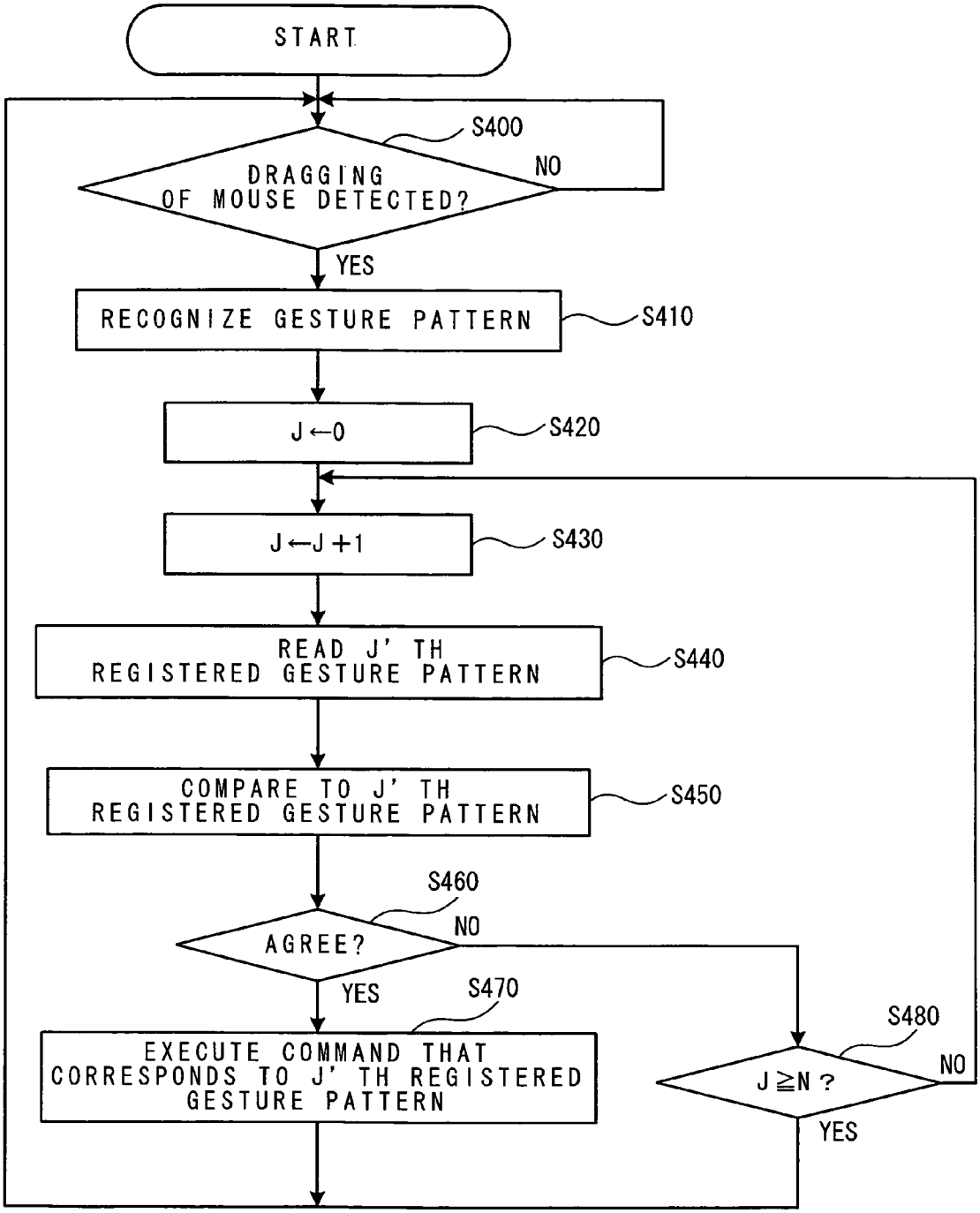
FIG. 27 is a flowchart of the mouse entry processing.

The following will describe a sewing machine 1 of a third embodiment in which a command that corresponds to a gesture pattern is executed, with reference to, for example, FIGS. 26 and 27. The physical configuration and the electrical configuration of the sewing machine 1 of the third embodiment are the same as those of the first embodiment and so explanation thereof is omitted below. It is to be noted that programs that execute processing pieces shown in FIG. 27 may be stored beforehand in the ROM 62 and so may be read into a program storage area 631 of the RAM 63 when the programs are performed and executed by, for example, the CPU 61, as shown in FIG. 3.

A table 800 in which registered gesture patterns may be stored will be described below with reference to FIG. 26. The table 800 may be referenced in the mouse entry processing of the third embodiment. In the third embodiment, if it is determined that the mouse 27 is being dragged on the basis of an output signal from the mouse 27, the CPU 61 may obtain the gesture pattern of the mouse 27. Then, the CPU 61 may compare that gesture pattern to a registered gesture pattern, which may be registered beforehand, to determine a command that may correspond to the input gesture pattern and execute it. As shown in FIG. 26, in the table 800 may respectively be stored an ID 801 used to identify a registered gesture pattern, a registered gesture pattern 802, a command 803 that may be assigned to the registered gesture pattern 802. The table 800 may be stored in a predetermined storage area of the ROM 62 or may be stored in the EEPROM 64 beforehand and read into a setting storage area 632 of the RAM 63 already when the mouse entry processing is performed.

Next, the mouse entry processing of the third embodiment will be described below with reference to, for example, FIG. 27. As shown in FIG. 27, the CPU 61 may first determine whether an output signal that corresponds to the dragging of the mouse 27 is detected (S400). If the output signal that corresponds to the dragging of the mouse 27 is not detected (NO at S400), the CPU 61 may wait until the output signal that corresponds to the dragging of the mouse 27 is detected. If the output signal that corresponds to the dragging of the mouse 27 is detected (YES at S400), the CPU 61 may obtain a gesture pattern based on the output signal of the mouse 27 being dragged (S410). As Example 3, such a case may be assumed that an alphabetic character of "Z" is written in its stroke order by using the mouse 27 with a left button of the mouse 27 held down. First, the CPU 61 may sequentially obtain relative coordinates of the mouse 27 during a time period when it is being dragged, based on an output signal provided by the movement detection section 35 of the mouse 27. Subsequently, the CPU 61 may obtain "Z" written in accordance with its alphabet stroke order as a gesture pattern of Example 3 based on those relative coordinates (S410). Subsequently, the CPU 61 may set a counter J to 0, which may be used to sequentially read the registered gesture pattern 802 in accordance with the ID 801, and may store it in a counter storage area (not shown) of the RAM 63 (S420). Subsequently, the CPU 61 may increment J by 1 and may store it in the counter storage area of the RAM 63 (S430).

Subsequently, the CPU 61 may reference the setting storage area 632 to read a J'th registered gesture pattern (S440). If J is 1, the CPU 61 may read as the first registered gesture pattern a circle drawn clockwise having such a lower end as shown in FIG. 26 as its starting point. Subsequently, the CPU 61 may compare the gesture pattern recognized at S410 and the J'th registered gesture pattern read at S440 (S450). In this processing for comparison, the CPU 61 may determine whether the movement trajectory of the gesture pattern recognized at S410 has a scaling relation with the registered gesture pattern and whether they have the same movement order. It is to be noted that in the determination on whether the movement trajectory of the gesture pattern recognized at S410 has a scaling relation with the registered gesture pattern, the CPU 61 may determine so even if there is a difference within a predetermined range. Subsequently, the CPU 61 may determine whether the gesture pattern recognized at S410 and the J'th registered gesture pattern read at S440 agree in terms of both movement trajectory and movement order (S460). Example 3 and the "circle drawn clockwise having the lower end as its starting point" as the first registered gesture pattern may agree in terms of neither movement trajectory or movement order (NO at S460). Therefore, the CPU 61 may determine whether the value of the counter J is at least the number N of the registered gesture patterns in order to determine whether all of the registered gesture patterns are read (S480). If J is at least N (YES at S480), the CPU 61 may return to S400 to repeat the processing. This processing may be performed in a case where all of the registered gesture patterns are read. On the other hand, if J is less than N (NO at S480), the CPU 61 may return to S430 to repeat the processing. This processing may be performed in a case where there is a registered gesture pattern that is not read.

At S440 where the processing is repeated, the CPU 61 may read alphabetic character "Z" that complies with the stroke order as a second registered gesture pattern (S440) and, subsequently, may compare the second registered gesture pattern "Z" and the gesture pattern "Z" of Example 3 (S450). Subsequently, the CPU 61 may determine that the second registered gesture pattern "Z" and the gesture pattern "Z" of Example 3 agree in terms of both movement trajectory and movement order (YES at S460). Subsequently, the CPU 61 may reference the setting storage area 632 to read a command that corresponds to the J'th registered gesture pattern and may execute it (S470). In Example 3, the CPU 61 may execute processing B that corresponds to a gesture pattern whose ID 801 is 2 (S470). Subsequently, the CPU 61 may return to S400 to repeat the processing. In such a manner, the CPU 61 may perform the mouse entry processing of the third embodiment.

According to the sewing machine 1 of the third embodiment, the mouse 27 may be equipped with the movement detection section 35 that may detect movement direction and a movement distance of the mouse 27 and may output a movement output signal indicative of them. When the mouse 27 is being dragged, a command may determine by recognizing a gesture pattern based on a plurality of the movement output signals that may be provided continually. Therefore, by moving the mouse 27 in a predetermined pattern as dragging, it may be possible to enter an instruction, which controls a predetermined operation of the sewing machine 1. In this case, a lot of gesture patterns that combine movement distances and movement directions may be operated. Further, to those gesture patterns, commands may be assigned, so that a lot of commands may be assigned to the gesture patterns even if the mouse 27 is equipped with fewer operation members.

It is to be noted that the above-detailed third embodiment may be changed variously. For example, although the third embodiment may use the mouse 27 equipped with the wheel 28 to enter an instruction, which controls a predetermined operation of the sewing machine 1, the present disclosure is not limited to it. When a game controller that is equipped with an A button, a B button, and a cross button having a cross-like shape and capable of entering four kinds of signals of UP, DOWN, RIGHT, and LEFT, is employed, if a predetermined output signal is provided, a command may be determined on the basis of a plurality of output signals, which are provided continually. For example, if the cross button on the game controller is operated with the A button held down, a command may be determined on the basis of a plurality of signals that are provided continually from the cross button (for example, signals provided when the "UP", "UP", and "DOWN" switch of the cross button are pressed in this order with the A button held down).

Although in the above-described third embodiment, an output signal provided during the dragging of the mouse 27 may correspond to a command, the present disclosure is not limited to it. An arbitrary output signal provided by the operation device of the mouse 27, etc., may correspond to the command. For example, when the above-described game controller is used to enter the instruction, as described above, an output signal that corresponds to the case of the cross button being operated with the A button held down may correspond to a command. Further, for example, when the mouse 27 is used to enter the instruction, commands, which instruct starting and ending of gesture pattern recognition, respectively, may be assigned to a predetermined operation member (for example, the right button 36) of the mouse 27 so that the output signal that may be detected during gesture pattern recognition may be performed and may correspond to the operation state of that operation member would correspond to the command. In this case, a gesture pattern may be recognized on the basis of the operations of the mouse 27 during a period from a point in time when the starting of gesture pattern recognition is instructed to a point in time when its ending is instructed by the respective output signals that correspond to the operation states of that operation member.

The above-described third embodiment may obtain a movement trajectory and movement order based on the movement operations of the mouse 27 during dragging and recognized them as a gesture pattern. Then, the gesture pattern may have been compared to a registered gesture pattern having a fixed shape and fixed movement order. However, the present disclosure is not limited to it. For example, either one of the movement trajectory and the movement order may be recognized as a gesture pattern. In this case, the gesture pattern may be compared to a registered gesture pattern that has either a fixed shape or fixed movement order that correspond to that gesture pattern.

Although the above-described third embodiment may have caused an output signal at the time of the dragging of the mouse 27 to correspond to a command and, upon the detection of the output signal at the time of the dragging of the mouse 27, may have recognized a gesture pattern, the present disclosure is not limited to it. For example, a gesture pattern may be recognized irrespective of whether the output signal corresponds to a command is detected.

Further, the above-described first through third embodiments and their modified embodiments may be combined appropriately.

It will be appreciated by those skill in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

What is claimed is:

1. A sewing machine comprising:

a needle bar;

a needle bar up-and-down movement mechanism that raises and lowers the needle bar;

a sewing machine motor that drives the needle bar up-and-down movement mechanism;

an operation device that is provided separately from a body of the sewing machine, and that includes at least one operation member to be operated by a user, the operation device outputting an output signal which corresponds to an operation state of the operation member;

a command determination device that determines a command which corresponds to the output signal outputted by the operation device as a determined command;

a drive control device that controls a predetermined operation of the sewing machine in accordance with the determined command determined by the command determination device;

a command selection device that selects a command, according to an instruction from the user, to be assigned to the output signal from among a plurality of different commands as a selected command; and a command assignment device that assigns the selected command selected by the command selection device to the output signal as an assigned command, wherein the command determination device references the assigned command assigned by the command assignment device, to determine the determined command that corresponds to the output signal provided by the operation device.

2. The sewing machine according to claim 1, wherein:

when the determined command determined by the command determination device is a sewing machine start/stop instruction for starting or stopping the sewing machine motor, the drive control device starts or stops the sewing machine motor in accordance with a driving state of the sewing machine motor.

3. The sewing machine according to claim 1, wherein:

when the determined command determined by the command determination device is a needle bar movement instruction for moving the needle bar by a distance which corresponds to the output signal, the drive control device moves the needle bar by the distance instructed by the needle bar movement instruction.

4. The sewing machine according to claim 1, wherein:

the operation device includes a movement output device as the operation member, the movement output device outputting a plurality of movement output signals, each of the movement output signals corresponding to a movement direction and a movement distance of the operation device; and the command determination device determines the determined command based on the plurality of movement output signals outputted from the movement output device.

5. The sewing machine according to claim 1, wherein when the output signal outputted by the operation device is a predetermined output signal, the command determination device determines the determined command based on a plurality of the output signals sequentially outputted from the operation device.

6. The sewing machine according to claim 1, wherein the operation device is a pointing device.

7. The sewing machine according to claim 1, wherein the operation device is a mouse having a wheel.

8. A computer-readable recording medium that stores a sewing machine operation program for operating a sewing machine, the sewing machine including an operation device that includes at least one operation member to be operated by a user, and that outputs an output signal which corresponds to an operation state of the operation member, the program comprising:

instructions for acquiring an output signal that corresponds to an operation state of an operation member;

instructions for determining a command that corresponds to the acquired output signal as a determined command;

instructions for controlling a predetermined operation of the sewing machine in accordance with the determined command;

instructions for acquiring a command, according to an instruction from the user, to be assigned to the output signal from among a plurality of different commands as an acquired command; and instructions for assigning the acquired command to the output signal as an assigned command, wherein the instructions for determining references the assigned command to determine the determined command that corresponds to the output signal.

9. The computer-readable recording medium according to claim 8, wherein when the determined command is a sewing machine motor start/stop instruction for starting or stopping a sewing machine motor of the sewing machine, the instructions for controlling conducts control to start or stop the sewing machine motor in accordance with a driving state of the sewing machine motor.

10. The computer-readable recording medium according to claim 8, wherein when the determined command is a needle bar movement instruction for moving a needle bar of the sewing machine by a distance which corresponds to the output signal, the drive control step controls the needle bar to move by the distance instructed by the needle bar movement instruction.

11. The computer-readable recording medium according to claim 8, wherein the instructions for determining determines the determined command based on a plurality of movement output signals which are sequentially outputted, each of the movement output signals corresponding to a movement direction and a movement distance.

12. The computer-readable recording medium according to claim 8, wherein when the instructions for determining determines the determined command based on a plurality of output signals which are sequentially outputted, wherein the output signal is a predetermined output signal.

* * * * *